US011362449B2

(12) United States Patent
Laursen

(10) Patent No.: US 11,362,449 B2
(45) Date of Patent: Jun. 14, 2022

(54) MINIATURIZED CONNECTOR

(71) Applicant: Estron A/S, Them (DK)

(72) Inventor: Carit Laursen, Them (DK)

(73) Assignee: ESTRON A/S, Them (DK)

( * ) Notice: Subject to any disclaimer, the term of this patent is extended or adjusted under 35 U.S.C. 154(b) by 138 days.

(21) Appl. No.: 16/604,793

(22) PCT Filed: May 2, 2018

(86) PCT No.: PCT/EP2018/061186

§ 371 (c)(1),
(2) Date: Oct. 11, 2019

(87) PCT Pub. No.: WO2018/202699

PCT Pub. Date: Nov. 8, 2018

(65) Prior Publication Data

US 2021/0296807 A1 Sep. 23, 2021

(30) Foreign Application Priority Data

May 3, 2017 (DK) ..... PA201770299
Jun. 14, 2017 (EP) ..... 17175914

(51) Int. Cl.
*H01R 13/05* (2006.01)
*H01R 9/05* (2006.01)
*H01R 24/38* (2011.01)

(52) U.S. Cl.
CPC ..... *H01R 13/052* (2013.01); *H01R 9/05* (2013.01); *H01R 24/38* (2013.01)

(58) Field of Classification Search
CPC ..... H01R 24/50; H01R 24/38
See application file for complete search history.

(56) References Cited

U.S. PATENT DOCUMENTS

| | | | | |
|---|---|---|---|---|
| 3,880,487 | A | 4/1975 | Goodman et al. | |
| 5,147,221 | A | 9/1992 | Cull et al. | |
| 5,376,022 | A | 12/1994 | Carr et al. | |
| 8,690,583 | B2 | 4/2014 | Uesaka et al. | |
| 9,356,376 | B2 | 5/2016 | Joschika | |
| 2003/0181099 | A1 | 9/2003 | Addario | |
| 2010/0184367 | A1 | 7/2010 | Chen et al. | |
| 2010/0323554 | A1 * | 12/2010 | Shiu | H01R 13/516 439/490 |
| 2011/0076896 | A1 | 3/2011 | Jol | |
| 2011/0254575 | A1 | 10/2011 | Uesaka et al. | |
| 2012/0309227 | A1 | 12/2012 | Montena | |

(Continued)

FOREIGN PATENT DOCUMENTS

| | | | |
|---|---|---|---|
| CN | 2134724 | Y | 5/1993 |
| CN | 2710217 | Y | 7/2005 |

(Continued)

OTHER PUBLICATIONS

International Search Report dated Jun. 29, 2018 for International Application No. PCT/EP2018/061186.

(Continued)

*Primary Examiner* — Ross N Gushi
(74) *Attorney, Agent, or Firm* — Crowell & Moring LLP; John C. Freeman

(57) ABSTRACT

Disclosed herein is a receptacle and a plug for a miniaturized connector for use in an audio device, a hearing device or a similar device.

26 Claims, 9 Drawing Sheets

(56) References Cited

U.S. PATENT DOCUMENTS

| | | | |
|---|---|---|---|
| 2014/0094048 | A1 | 4/2014 | Dilmaghanian |
| 2015/0340820 | A1 | 11/2015 | Joschika |

FOREIGN PATENT DOCUMENTS

| | | | |
|---|---|---|---|
| CN | 102239602 | A | 11/2011 |
| CN | 104380536 | A | 2/2015 |
| JP | S 59-74680 | A | 5/1984 |
| JP | 2000150073 | A | 5/2000 |
| JP | 2014-89821 | A | 5/2014 |
| JP | 2015-518261 | A | 6/2015 |
| WO | WO 2010/042926 | A2 | 4/2010 |
| WO | WO 2013/178267 | A1 | 12/2013 |

OTHER PUBLICATIONS

International Preliminary Report on Patentability completed Aug. 6, 2019 for International Application No. PCT/EP2018/061186.

Office Action dated Oct. 22, 2020 from corresponding (Chinese) Patent Application No. 201880028110.5 (8 pages) English Translation Attached.

Notice of Reasons for Rejection dated Mar. 14, 2022 from corresponding Japanese Application 2019-560268 (5 pages Japanese language and 6 page English translation).

* cited by examiner

MINIATURIZED CONNECTOR

This application claims the benefit under 35 U.S.C. § 371 of International Application No. PCT/EP2018/061186, filed May 2, 2018, which claims the priority of Danish Patent Application No. PA 201770299, filed May 3, 2017 and European Application No. 17175914.5, filed Jun. 14, 2017; which are incorporated by reference herein in their entirety.

The invention relates to a miniaturized connector mainly for the audio industry. The connector comprises a plug and a receptacle, where the receptacle is adapted for being assembled into a device, e.g. ear piece, ear monitor or other parts, and the plug is via a cable connected to a source for electrical power.

BACKGROUND

Electrical connectors are used almost in every possible industry, where two objects need to be electrically connected. In applications, e.g. hearing aids, ear monitors used in the security, TV, and music industry and similar, where space and appearance are of big importance and the size of the electrical connectors needs to be small in order to fit into e.g. electrical devices.

Examples of such connectors are the commonly known micro jack connectors, which are used in e.g. cell phones, mp3 players or the like for connecting earphones with the device.

The micro jack connectors comprise a plug with a set of contact points, typically three contact points, and a receptacle (mounted in e.g. the cell phone or the mp3 layer) having a matching set of contact points each being in electrical contact with one corresponding electrical contact point on the plug, when the plug is inserted in the receptacle.

The outer diameter of the plug in micro jack connectors is often on the order of 2-3 mm and the length of the plug is on the order of 1-3 cm.

The construction of these commonly known micro jack connectors makes it rather difficult to reduce their size further.

DESCRIPTION OF THE INVENTION

Disclosed herein is in a first aspect of the invention a receptacle for a miniaturized connector for use in an audio device, a hearing device or a similar device, the receptacle extending from a rear end towards of front end, wherein the receptacle comprises an inner receptacle part comprising:

- a receptacle contact pin extending from a rear end to a front end;
- an inner contact base extending from a rear end to a front end, wherein the inner contact base comprises a through-going opening through which the receptacle contact pin extends, and one or more additional openings;
- an inner contact spring extending from a rear end to a front end, the inner contact spring being secured at its rear end inside the one or more additional openings in the inner contact base, and
- an insulator extending from a rear end to a front end, and having a through-going opening containing the front ends of the inner contact spring, the inner contact base, and the contact pin, wherein the receptacle contact pin, and contact spring are adapted for making electrical contact with two plug parts in a plug, when the plug is inserted inside the receptacle.

By the above receptacle is obtained an improved compact receptacle which can withstand wear on the receptacle. This prolongs the lifetime of the receptacle.

The receptacle may be produced in a moulding process.

In one or more embodiments, the rear end of the inner contact pin protrudes from the rear end of the inner contact base.

In one or more embodiments, the front end of the inner contact pin protrudes from the front end of the inner contact base.

In one or more embodiments, at least one of the one or more additional openings is extending all the way through the inner contact base.

In one or more embodiments, the inner contact spring comprises a contact protrusion at the rear end of the inner contact spring, the contact protrusion extending rearward from the rear end of the inner contact base allowing electrical contact to be made with the inner contact spring.

In one or more embodiments, the inner contact spring comprises a number of protruding string parts extending from the rear end of the inner contact spring in an approximately straight line towards the front end of the inner contact spring where the protruding string parts bends towards a centre point of the inner contact spring.

In one or more embodiments, the protruding string parts are flexible.

In one or more embodiments, the inner contact base is an insulator. The insulator and the inner contact base are normally two separate items, which are assembled such that the front end of the inner contact base extends inside the opening in the insulator. This is in contrast to the receptacle shown in US 2015/340820 A1, where only one combined insulator is utilized. The two-part insulator setup according to this invention allows for an easier assembly of the receptacle with the receptacle contact pin and the inner contact spring.

Alternatively, the insulator and the inner contact base may be formed as one combined insulator also included in this invention. When formed as one combined insulator, the combined insulator comprises an opening at the front end, which allows a plug access to an inner cavity of the combined insulator. The inner cavity of the combined insulator extends through the length of the combined insulator until a small opening in the rear end of the combined insulator. Through this small opening, the inner contact pin extends. The combined insulator will also contain a forward protruding part inside the inner cavity, which extends from the rear end of the combined insulator and into the inner cavity. It will normally be along this part of the combined insulator that the inner contact spring front end extends into the inner cavity.

In one or more embodiments, the rear end of the receptacle contact pin extends rearward from the rear end of the inner contact base allowing electrical contact to be made with the receptacle contact pin.

In one or more embodiments, the receptacle further comprises:

- an outer contact tube extending from a rear end to a front end, and having a through-going opening wherein the inner receptacle part extends through the outer contact tube;
- an outer contact spring extending around the outer contact tube from a rear end to a front end;
- an outer insulator extending from a rear end to a front end, the outer insulator being positioned between the outer contact tube and the outer contact spring, a housing extending from a rear end to a front end, the housing enclosing the outer contact spring, the outer insulator, the outer contact tube and the inner receptacle part, wherein the outer contact tube, and the outer contact spring are adapted for making electrical contact with two additional plug parts of the plug, when the plug is inserted inside the receptacle.

In one or more embodiments, the outer contact spring comprises a ring shaped part at the rear end of the outer contact spring from where a number of contact extensions extend towards the front end of the outer contact spring.

In one or more embodiments, the number of contact extensions includes two contact extensions.

In one or more embodiments, the rear end of the outer contact spring is positioned at the rear end of the receptacle allowing electrical contact to be made with the outer contact spring.

In one or more embodiments, the outer contact tube comprises a contact protrusion at the rear end of the outer contact tube.

In one or more embodiments, the contact protrusion of the outer contact tube protrudes from the rear end of the inner contact base allowing electrical contact to be made with the outer contact tube.

Disclosed herein in a second aspect of the invention is a plug for a miniaturized connector for use in an audio device, a hearing device or a similar device, wherein the plug comprises an internal plug part comprising:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and a contact tube having a front end, a rear end and a through-going opening through which the inner insulator extends, wherein the contact tube further comprises a fixation recess, wherein the inner contact spring and the contact tube are adapted for making electrical contact with two receptacle contact parts, when the plug is inserted inside the receptacle.

In one or more embodiments, the rear end of the insulator is in direct contact with the rear end of the contact tube.

In one or more embodiments, the front end of the contact tube is tapered.

In one or more embodiments, the contact tube further comprises a first outer protrusion and the second outer protrusion.

In one or more embodiments, the inner contact spring comprises a number of extending arms extending from a ring shaped part at the front end of the inner contact spring towards the rear end of the inner contact spring.

In one or more embodiments, the rear end of the plug contact pin extends from the rear end of the inner insulator thereby allowing the plug contact pin to be electrically connected to a first wire comprised in a cable.

In one or more embodiments, the rear end of the contact tube is electrically connected to a second wire comprised in a cable.

In one or more embodiments, the plug further comprises the cable with a number of wires including at least the first wire and the second wire.

In one or more embodiments, the plug further comprises a hollow assembly tube, the hollow assembly tube extending from a rear end to a front end, wherein enclosed in the hollow assembly tube and extending from its front end is the internal plug part.

In one or more embodiments the plug further comprises a lip seal positioned around the contact tube.

In one or more embodiments the plug further comprises a lip seal positioned between the hollow assembly tube and the contact tube.

In one or more embodiments the plug further comprises a lip seal positioned between the front end of the hollow assembly tube and the contact tube.

In one or more embodiments, the lip seal compresses when the plug is connected with the receptacle.

In one or more embodiments, the lip seal extends radially all the way around an outer surface of the contact tube.

In one or more embodiments, the plug further comprises:

an outer insulator extending from a rear end to a front end and having a rear end ring protrusion at the rear end of the outer insulator, wherein the outer insulator is positioned inside the hollow assembly tube extending at least partly there through with the rear end ring protrusion being in direct contact with the rear end of the assembly tube, and an outer contact spring positioned between the outer insulator and the internal plug part, the outer contact string extending from a rear end to a front end and having an opening at the rear end through which the rear end of the plug contact pin extends, wherein the outer contact spring and the assembly tube are adapted for making electrical contact with two additional receptacle contact parts, when the plug is inserted inside the receptacle.

In one or more embodiments, the outer contact spring comprises a plate shaped part surrounding the opening at the rear end of the outer contact spring from where a number of contact extensions extend towards the front end of the outer contact spring.

In one or more embodiments, the plate shaped part is electrically connected to a third wire in a cable.

In one or more embodiments, the assembly tube is electrically connected to a fourth wire in a cable.

In one or more embodiments, the cable comprises the third wire and the fourth wire.

Disclosed herein in a third aspect of the invention is a miniaturized connector for use in an audio device, a hearing device or a similar device, wherein the connector comprises a receptacle according to the above and a plug according to the above.

In one or more embodiments, when the plug is inserted into the receptacle, there is a first electrical connection between the front end of the receptacle contact pin extending inside the inner contact spring of the plug positioned inside the plug contact pin opening.

In one or more embodiments, when the plug is inserted into the receptacle, there is a second electrical connection between the contact tube of the receptacle and the inner contact spring of the plug.

In one or more embodiments, the front end of the contact spring engages with the fixation recess of the contact tube thereby securing the plug inside the receptacle.

In one or more embodiments, when the plug is inserted into the receptacle, there is a third electrical connection between the outer contact spring of the plug and the outer contact tube of the receptacle.

In one or more embodiments, when the plug is inserted into the receptacle, there is a fourth electrical connection between the assembly tube of the plug and the outer contact spring of the receptacle.

Disclosed herein in a third aspect of the invention is a receptacle for a miniaturized connector for use in an audio device, a hearing device or a similar device, the receptacle extending from a rear end towards of front end, wherein the receptacle comprises:

an inner receptacle part comprising:

a receptacle contact pin extending from a rear end to a front end;

an inner contact base extending from a rear end to a front end, wherein the inner contact base comprises a through-going opening through which the receptacle contact pin extends, and one or more additional openings;

an inner contact spring extending from a rear end to a front end, the inner contact spring being secured at its rear end inside the one or more additional openings in the inner contact base, and an insulator extending from a rear end to a front end, and having a through-going opening containing the front ends of the inner contact spring, the inner contact base, and the contact pin, an outer contact tube extending from a rear end to a front end, and having a through-going opening, wherein the inner receptacle part extends through the outer contact tube;

a housing extending from a rear end to a front end, the housing enclosing the outer contact tube and the inner receptacle part, wherein the receptacle contact pin, inner contact spring, and the outer contact tube are adapted for making electrical contact with three plug parts in a plug, when the plug is inserted inside the receptacle.

Disclosed herein in a fourth aspect of the invention is a receptacle for a miniaturized connector for use in an audio device, a hearing device or a similar device, the receptacle extending from a rear end towards of front end, wherein the receptacle comprises:

an inner receptacle part comprising:

a receptacle contact pin extending from a rear end to a front end;

an inner contact base extending from a rear end to a front end, wherein the inner contact base comprises a through-going opening through which the receptacle contact pin extends, and one or more additional openings;

an inner contact spring extending from a rear end to a front end, the inner contact spring being secured at its rear end inside the one or more additional openings in the inner contact base, and an insulator extending from a rear end to a front end, and having a through-going opening containing the front ends of the inner contact spring, the inner contact base, and the contact pin, an outer contact spring extending around the inner receptacle part from a rear end to a front end;

a housing extending from a rear end to a front end, the housing enclosing the outer contact spring, and the inner receptacle part, wherein the receptacle contact pin, inner contact spring, and the outer contact spring are adapted for making electrical contact with three plug parts in a plug, when the plug is inserted inside the receptacle.

Disclosed herein in a fifth aspect of the invention is a receptacle for a miniaturized connector for use in an audio device, a hearing device or a similar device, the receptacle extending from a rear end towards of front end, wherein the receptacle comprises:

an inner receptacle part comprising:

a receptacle contact pin extending from a rear end to a front end;

an inner contact base extending from a rear end to a front end, wherein the inner contact base comprises a through-going opening through which the receptacle contact pin extends, and one or more additional openings;

an insulator extending from a rear end to a front end, and having a through-going opening containing the inner contact base, and the contact pin, an outer contact tube extending from a rear end to a front end, and having a through-going opening, wherein the inner receptacle part extends through the outer contact tube;

an outer contact spring extending around the outer contact tube from a rear end to a front end;

an outer insulator extending from a rear end to a front end, the outer insulator being positioned between the outer contact tube and the outer contact spring, a housing extending from a rear end to a front end, the housing enclosing the outer contact spring, the outer insulator, the outer contact tube and the inner receptacle part, wherein the receptacle contact pin, the outer contact tube, and the outer contact spring are adapted for making electrical contact with three plug parts in a plug, when the plug is inserted inside the receptacle.

Disclosed herein in a sixth aspect of the invention is a receptacle for a miniaturized connector for use in an audio device, a hearing device or a similar device, the receptacle extending from a rear end towards of front end, wherein the receptacle comprises:

an inner receptacle part comprising:

an inner contact base extending from a rear end to a front end, wherein the inner contact base comprises one or more additional openings;

an inner contact spring extending from a rear end to a front end, the inner contact spring being secured at its rear end inside the one or more additional openings in the inner contact base, and an insulator extending from a rear end to a front end, and having a through-going opening containing the front ends of the inner contact spring, and the inner contact base, an outer contact tube extending from a rear end to a front end, and having a through-going opening, wherein the inner receptacle part extends through the outer contact tube;

an outer contact spring extending around the outer contact tube from a rear end to a front end;

an outer insulator extending from a rear end to a front end, the outer insulator being positioned between the outer contact tube and the outer contact spring, a housing extending from a rear end to a front end, the housing enclosing the outer contact spring, the outer insulator, the outer contact tube and the inner receptacle part, wherein inner contact spring, the outer contact tube, and the outer contact spring are adapted for making electrical contact with three plug parts in a plug, when the plug is inserted inside the receptacle.

The third, fourth, fifth, and sixth aspect of the invention each includes three contact points for making electrical contact with three plug parts in a plug.

Disclosed herein is further in a seventh aspect of the invention a plug for a miniaturized connector for use in an audio device, a hearing device or a similar device, wherein the plug comprises an internal plug part and a hollow assembly tube, the hollow assembly tube extending from a rear end to a front end, wherein enclosed in the hollow assembly tube and extending from its front end is the internal plug part, the internal plug part comprising:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and a contact tube having a front end, a rear end and a through-going opening through which the inner insulator extends, wherein the contact tube further comprises a fixation recess, wherein the plug further comprises:

an outer insulator extending from a rear end to a front end and having a rear end ring protrusion at the rear end of the outer insulator, wherein the outer insulator is positioned inside the hollow assembly tube extending at least partly there through with the rear end ring protrusion being in direct contact with the rear end of the assembly tube, and an outer contact spring positioned between the outer insulator and the internal plug part, the outer contact string extending from a rear end to a front end and having an opening at the rear end through which the rear end of the plug contact pin extends, wherein the inner contact spring, the contact tube, and the outer contact spring are adapted for making electrical contact with three additional receptacle contact parts, when the plug is inserted inside the receptacle.

Disclosed herein in an eight aspect of the invention is a plug for a miniaturized connector for use in an audio device, a hearing device or a similar device, wherein the plug comprises an internal plug part and a hollow assembly tube, the hollow assembly tube extending from a rear end to a front end, wherein enclosed in the hollow assembly tube and extending from its front end is the internal plug part, the internal plug part comprising:

an inner insulator with a through-going opening extending from a front end to a rear end of the inner insulator, and a contact tube having a front end, a rear end and a through-going opening through which the inner insulator extends, wherein the contact tube further comprises a fixation recess, wherein the plug further comprises:

an outer insulator extending from a rear end to a front end and having a rear end ring protrusion at the rear end of the outer insulator, wherein the outer insulator is positioned inside the hollow assembly tube extending at least partly there through with the rear end ring protrusion being in direct contact with the rear end of the assembly tube, and an outer contact spring positioned between the outer insulator and the internal plug part, the outer contact string extending from a rear end to a front end, wherein the the contact tube, the outer contact spring and the assembly tube are adapted for making electrical contact with three additional receptacle contact parts, when the plug is inserted inside the receptacle.

Disclosed herein in a ninth aspect of the invention is a plug for a miniaturized connector for use in an audio device, a hearing device or a similar device, wherein the plug comprises an internal plug part and a hollow assembly tube, the hollow assembly tube extending from a rear end to a front end, wherein enclosed in the hollow assembly tube and extending from its front end is the internal plug part, the internal plug part comprising:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and wherein the plug further comprises:

an outer insulator extending from a rear end to a front end and having a rear end ring protrusion at the rear end of the outer insulator, wherein the outer insulator is positioned inside the hollow assembly tube extending at least partly there through with the rear end ring protrusion being in direct contact with the rear end of the assembly tube, and an outer contact spring positioned between the outer insulator and the internal plug part, the outer contact string extending from a rear end to a front end and having an opening at the rear end through which the rear end of the plug contact pin extends, wherein the inner contact spring, the outer contact spring and the assembly tube are adapted for making electrical contact with three additional receptacle contact parts, when the plug is inserted inside the receptacle.

Disclosed herein in a tenth aspect of the invention is a plug for a miniaturized connector for use in an audio device, a hearing device or a similar device, wherein the plug comprises an internal plug part and a hollow assembly tube, the hollow assembly tube extending from a rear end to a front end, wherein enclosed in the hollow assembly tube and extending from its front end is the internal plug part, the internal plug part comprising:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and a contact tube having a front end, a rear end and a through-going opening through which the inner insulator extends, wherein the contact tube further comprises a fixation recess, wherein the inner contact spring and the contact tube, and the assembly tube are adapted for making electrical contact with three additional receptacle contact parts, when the plug is inserted inside the receptacle.

The seventh, eighth, ninth, and tenth aspect of the invention each includes three contact points for making electrical contact with three receptacle parts in a receptacle.

In regards to the receptacle parts, the term 'front end' is in general understood as the end pointing towards the plug, when the two parts are connected, and the 'rear end' is understood as the end pointing away from the plug.

In regards to the plugs, the term 'front end' is in general understood as the end pointing towards the receptacle part, when the two parts are connected, and the 'rear end' is understood as the end pointing away from the receptacle.

SHORT DESCRIPTION OF THE DRAWINGS

Figure 7A:
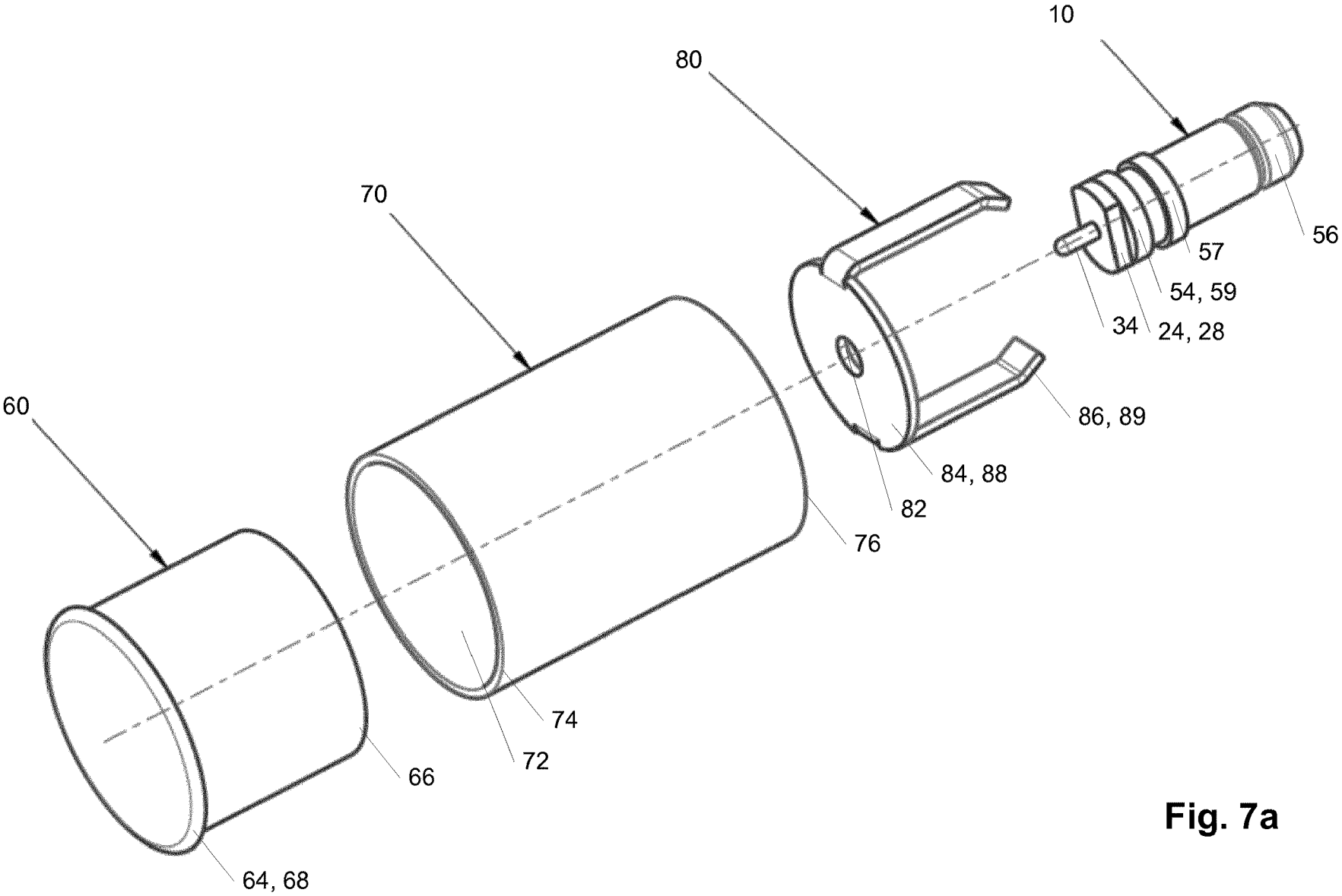
Figure 7B:
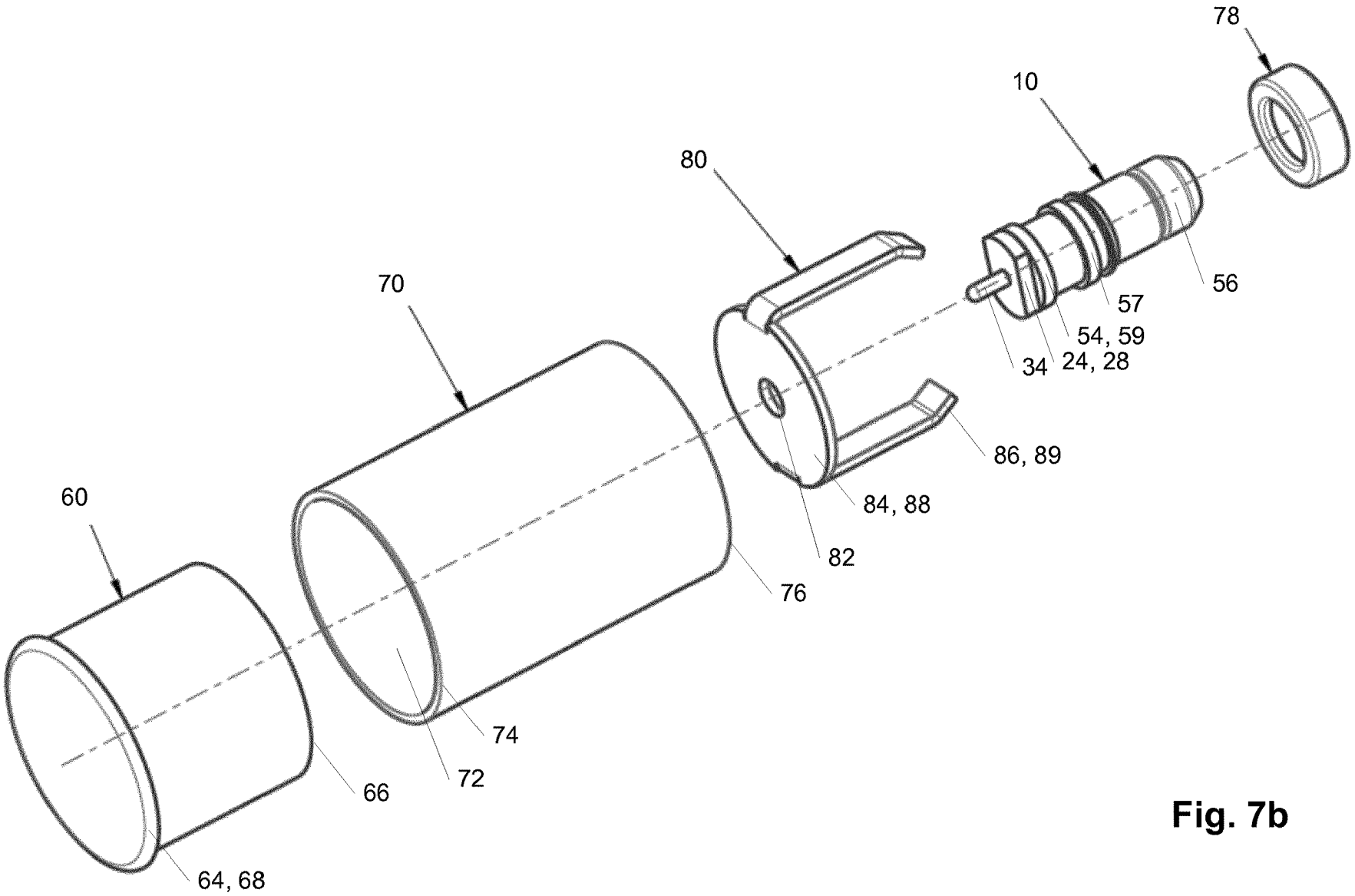
Figure 7C:
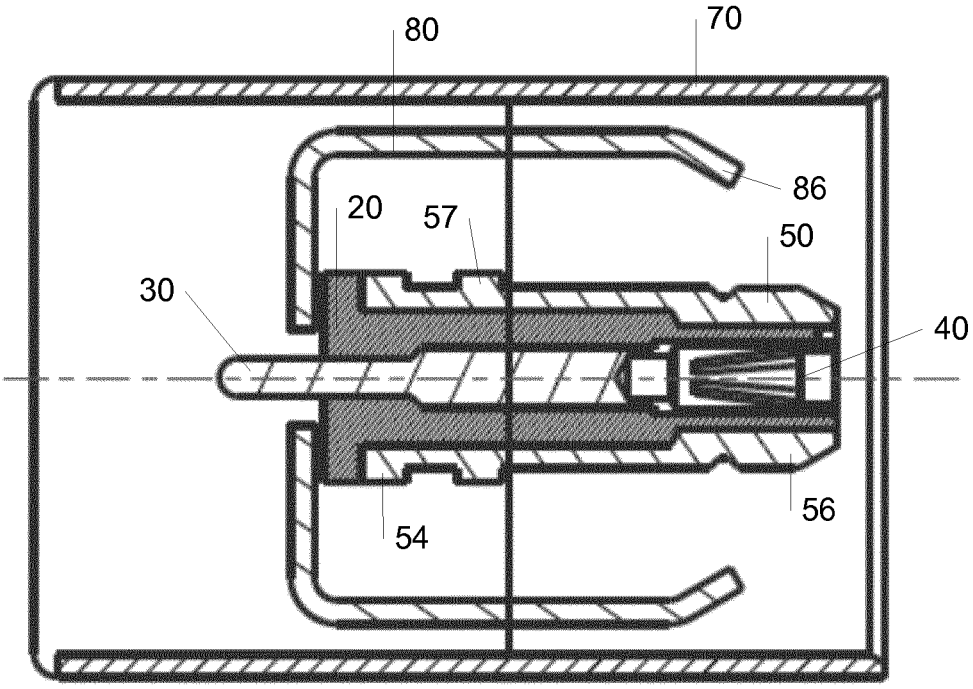
Figure 7D:
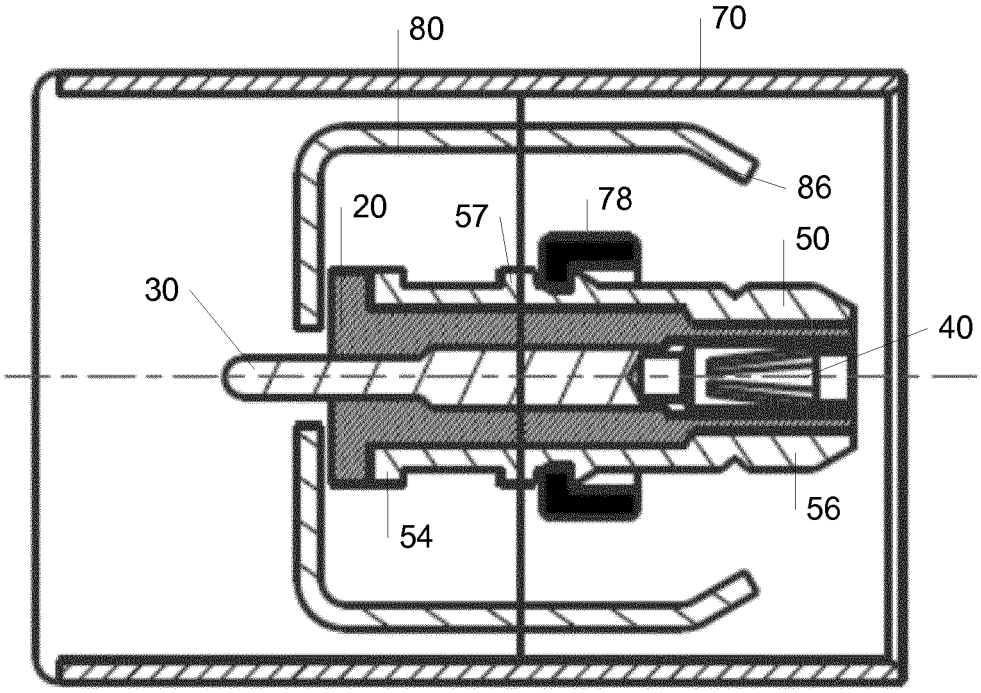

FIG. 7*a* and FIG. 7*b* show embodiments of the plug in an exploded view and FIG. 7*c* and FIG. 7*d* show a cut-through view of the assembled plugs shown in FIG. 7*a* and FIG. 7*b*, respectively.

Figure 8:
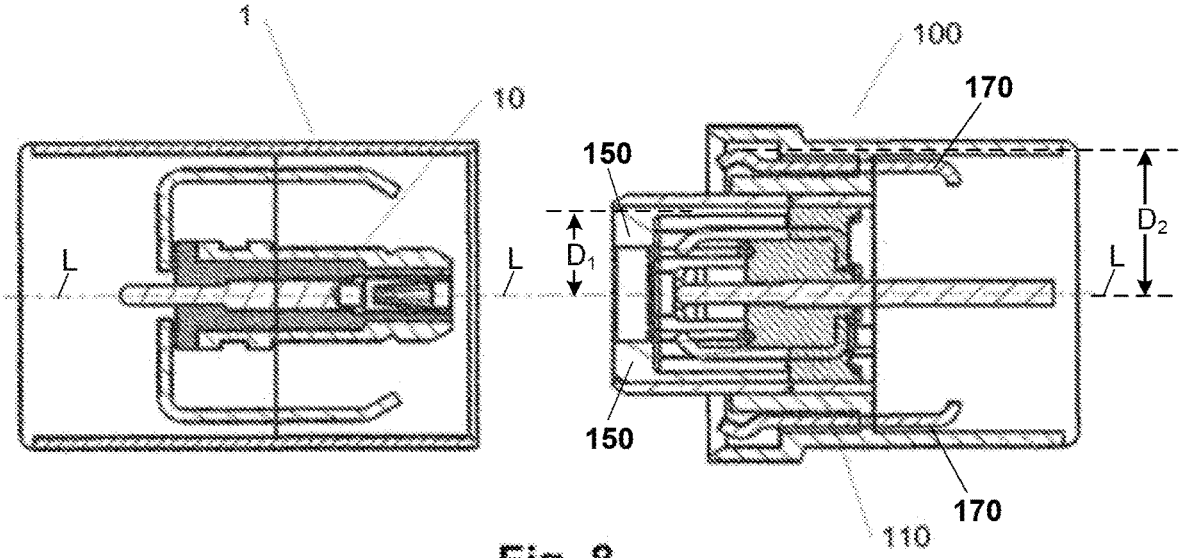

FIG. 8 shows a plug and a receptacle not yet being connected.

Figure 9:
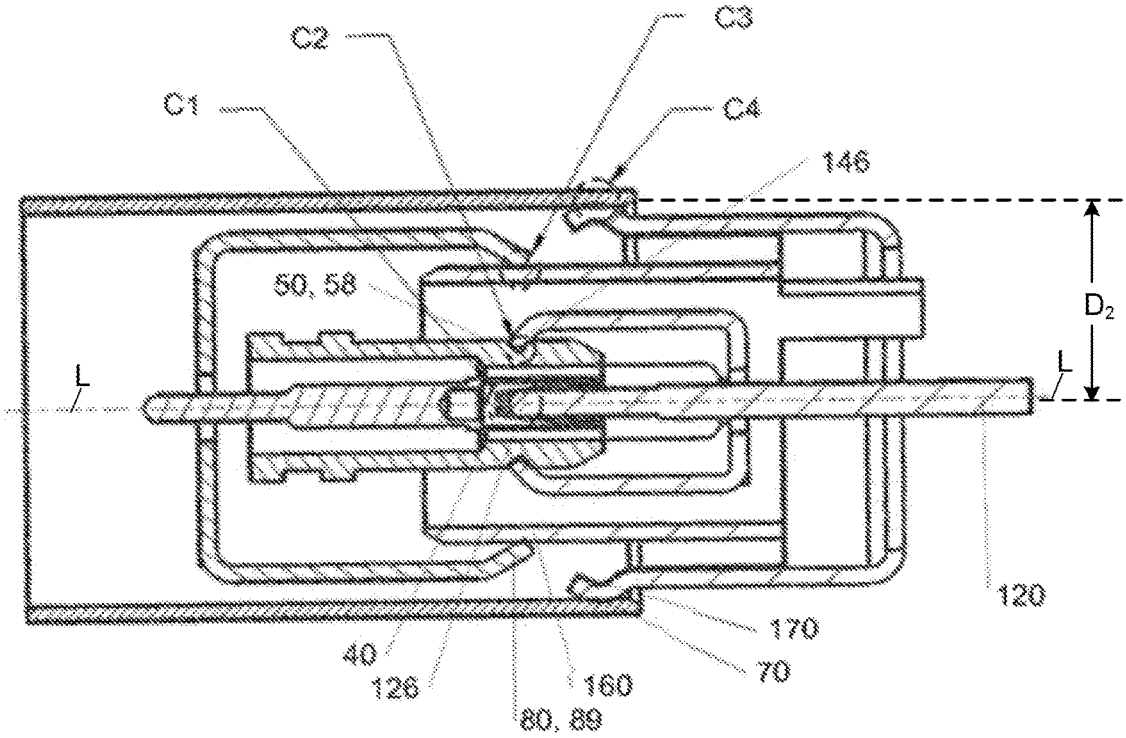

FIG. 9 shows the plug and the receptacle of FIG. 8 being connected.

Figure 10A:
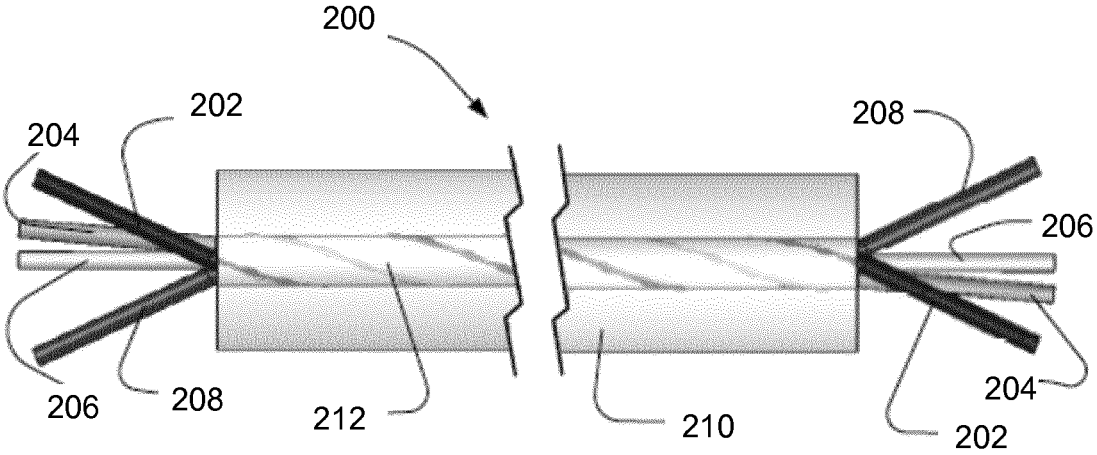
Figure 10B:
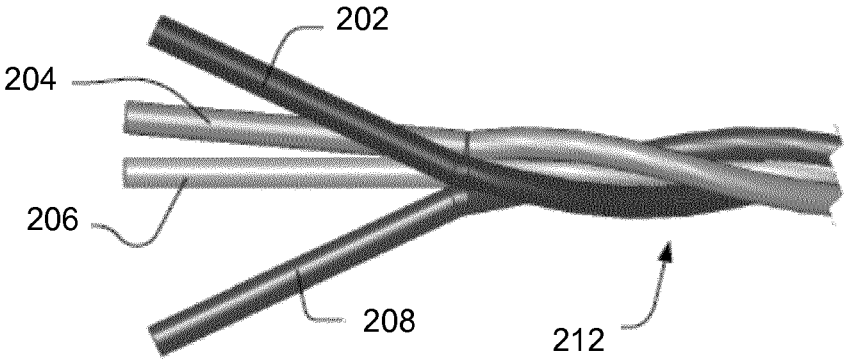

FIGS. 10*a-b* show an embodiment of a cable connected to a plug according to the invention.

The different items are identified by the numerals given in the reference list.

DETAILED DESCRIPTION OF THE EMBODIMENTS

Figure 1:
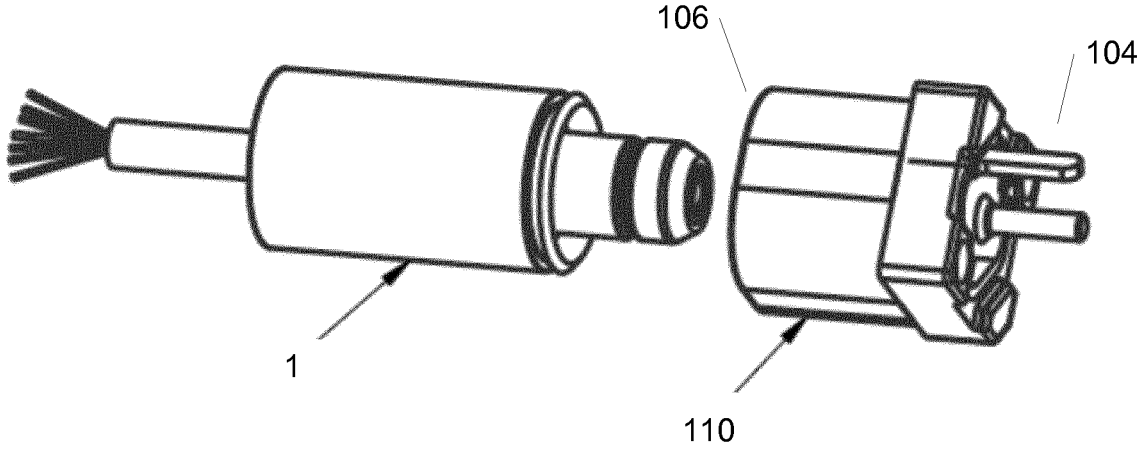
FIG. 1 shows a first embodiment of an inner receptacle part and a plug.

FIG. 1 shows a first embodiment of an inner receptacle part 110 and a plug 10 not connected. When the parts are connected, two connection points are formed thereby forming a miniaturized connector for use in e.g. an audio device, a hearing device or a similar device.

Figure 4:
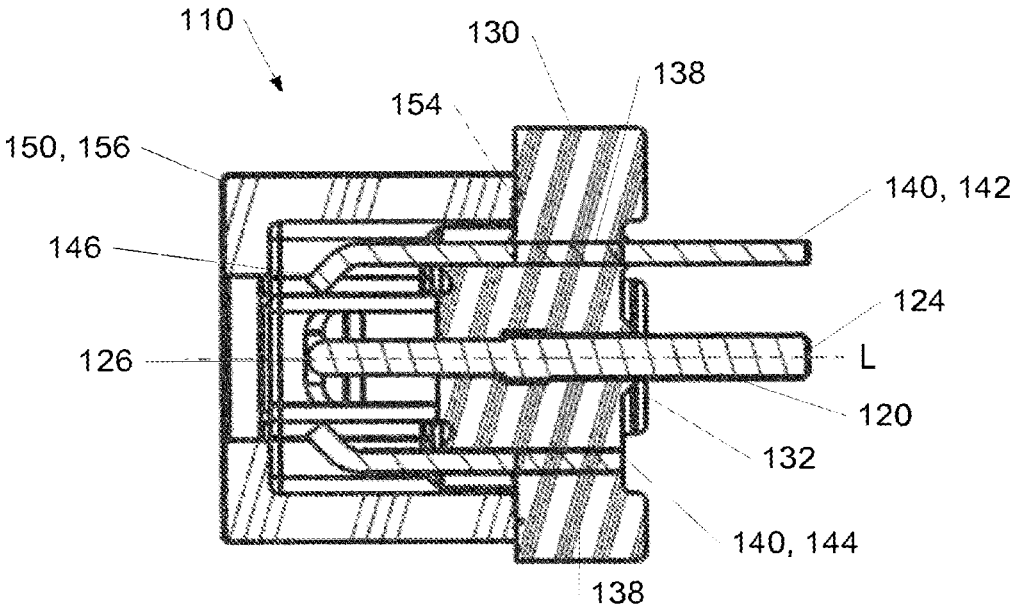
FIG. 4 shows an embodiment of an inner receptacle part.

In FIG. 4 a cut-through of the inner receptacle 110 is shown, where the different component can be seen in greater detail. Also, in FIG. 5 an exploded view of the inner receptacle 110 is shown as part of a larger receptacle 100. The receptacle 100 extends from a rear end 104 towards of front end 106. Comprised in the inner receptacle part 110 is a receptacle contact pin 120 having a rear end 124 and a front end 126. The rear end 124 of the receptacle contact pin 120 extends rearwardly from the rear end 134 of an inner contact base 130 allowing an electrical contact to be made with the receptacle contact pin 120 at the rear end of the inner receptacle 110.

The inner receptacle also comprises an inner contact base 130 extending from a rear end 134 to a front end 136. The inner contact base serves as an insulator, and has a through-going opening 132 through which the receptacle contact pin 120 extends. As shown in FIG. 4, the rear end 124 of the inner contact pine 120 protrudes from the rear end 134 of the inner contact base 130, which allows for making a further electrical connection to the units into which the receptacle is inserted/mounted.

The front end 126 of the inner contact pin 120 protrudes from the front end 136 of the inner contact base 130, which enables the front end 126 of the contact pin 120 to make an electrical connection with plug parts as shown in FIG. 9.

The inner contact base 130 also has one or more additional openings 138, through which an inner contact spring 140 is secured at its rear end 144. The front end 146 of the inner contact spring 140 will make an electrical connection with the plug parts (see description of FIG. 9 for more details). One of the one or more additional openings 138 may be extending all the way through the inner contact base 130 as shown in FIG. 4.

The inner receptacle 110 also includes an insulator 150 extending from a rear end 154 to a front end 156. There is a through-going opening 152 in the insulator 150, which contains the front ends 146, 136, 126 of the inner contact spring 140, the inner contact base 130, and the contact pin 120. As shown in FIGS. 4, 5, 8, and 9, the inner contact pin 120 extends along a longitudinal axis L from a rear end to a front end. As shown in FIG. 8, the insulator 150 extends a maximum radial distance $D_1$ as measured from the longitudinal axis L.

The inner contact spring 140 has a contact protrusion 142 at the rear end 144 of the inner contact spring 140, which extends rearwardly from the rear end 134 of the inner contact base 130. The contact protrusion 142 allows for an electrical contact to be made with the units into which the receptacle is inserted/mounted.

Figure 5:
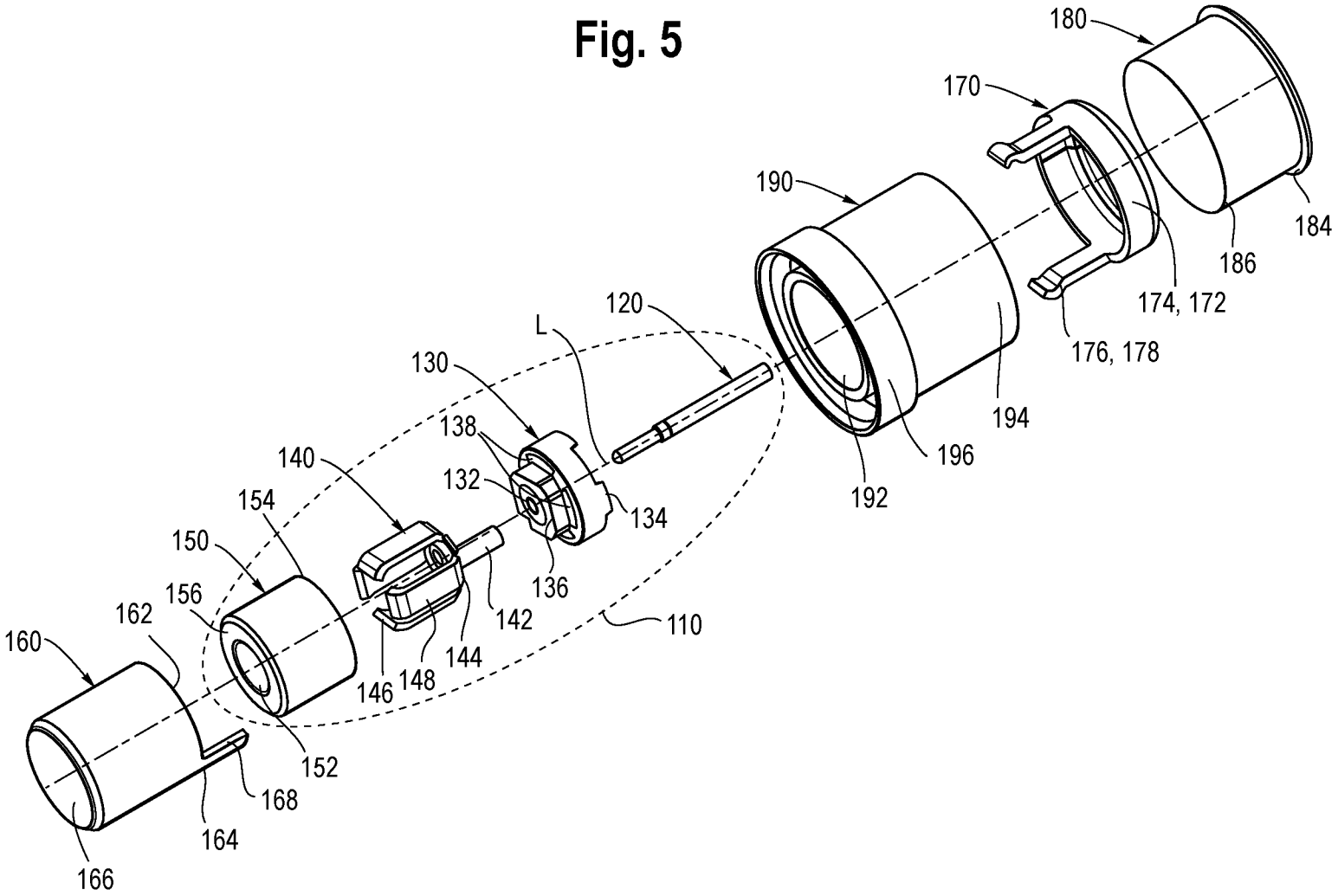
FIG. 5 shows an exploded view of a receptacle according to the invention.

As shown in FIG. 5, the inner contact spring 140 may have a number of protruding parts 148 formed as arms or strings extending from the rear end 144 of the inner contact spring 140 in an approximately straight line towards the front end 146 of the inner contact spring 140. At the front end 144, the protruding parts 148 bends towards a centre point of the inner contact spring. The parts 148 may be flexible or flexibly connected to the rear end 146 of the inner contact spring 140 such that the parts 148 can be pushed outwardly when a plug is inserted into the receptacle. The parts 148 will resume their original configuration upon removal of the plug. In FIG. 5, four string parts are shown. However, more or fewer such as e.g. two, three, five, six, seven, or more may also be imaginged.

The receptacle may be produced in a moulding process.

Figure 3:
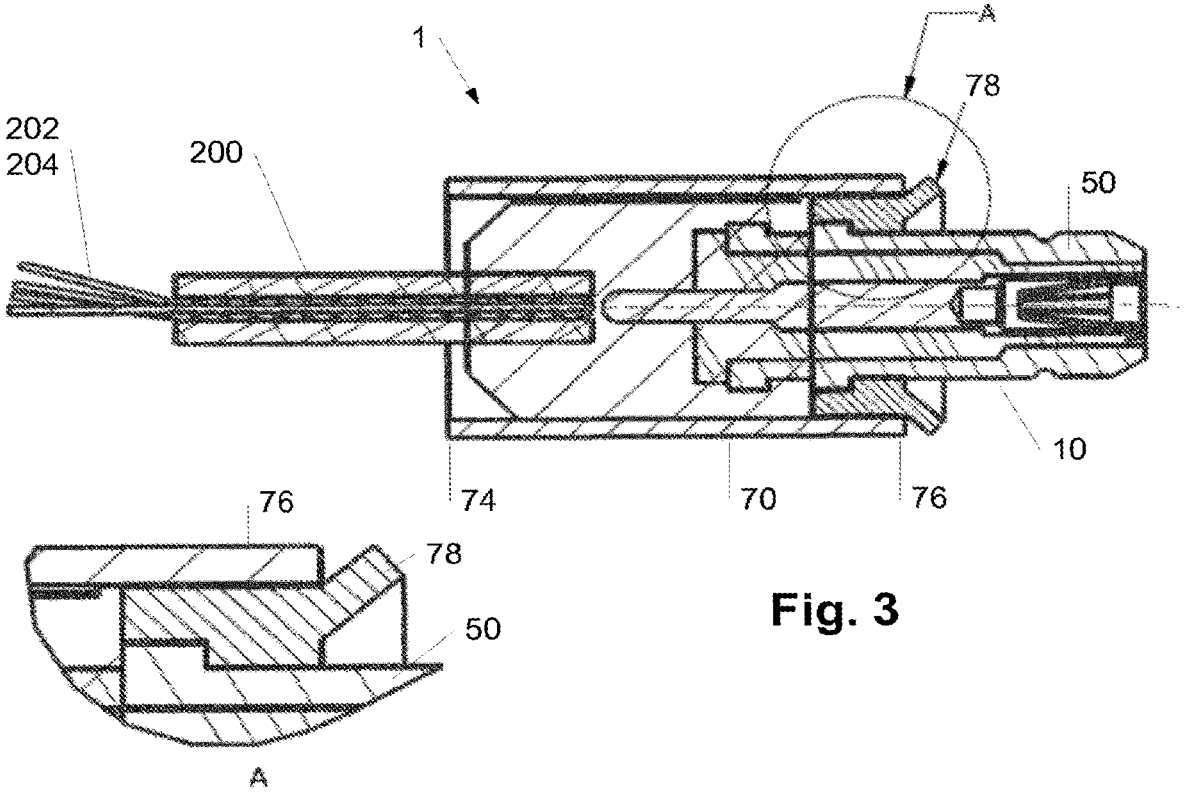
FIG. 3 shows an embodiment of the plug connected to a cable.

In FIG. 3 a cut-through of the plug 10 shown in FIG. 1 is shown displaying the different items more clearly. The plug 1 comprises an internal plug part 10, which is shown in an exploded view in FIG. 6. The internal plug part 10 comprises a hollow assembly tube 70 extending from a rear end 74 to a front end 76.

Figure 6:
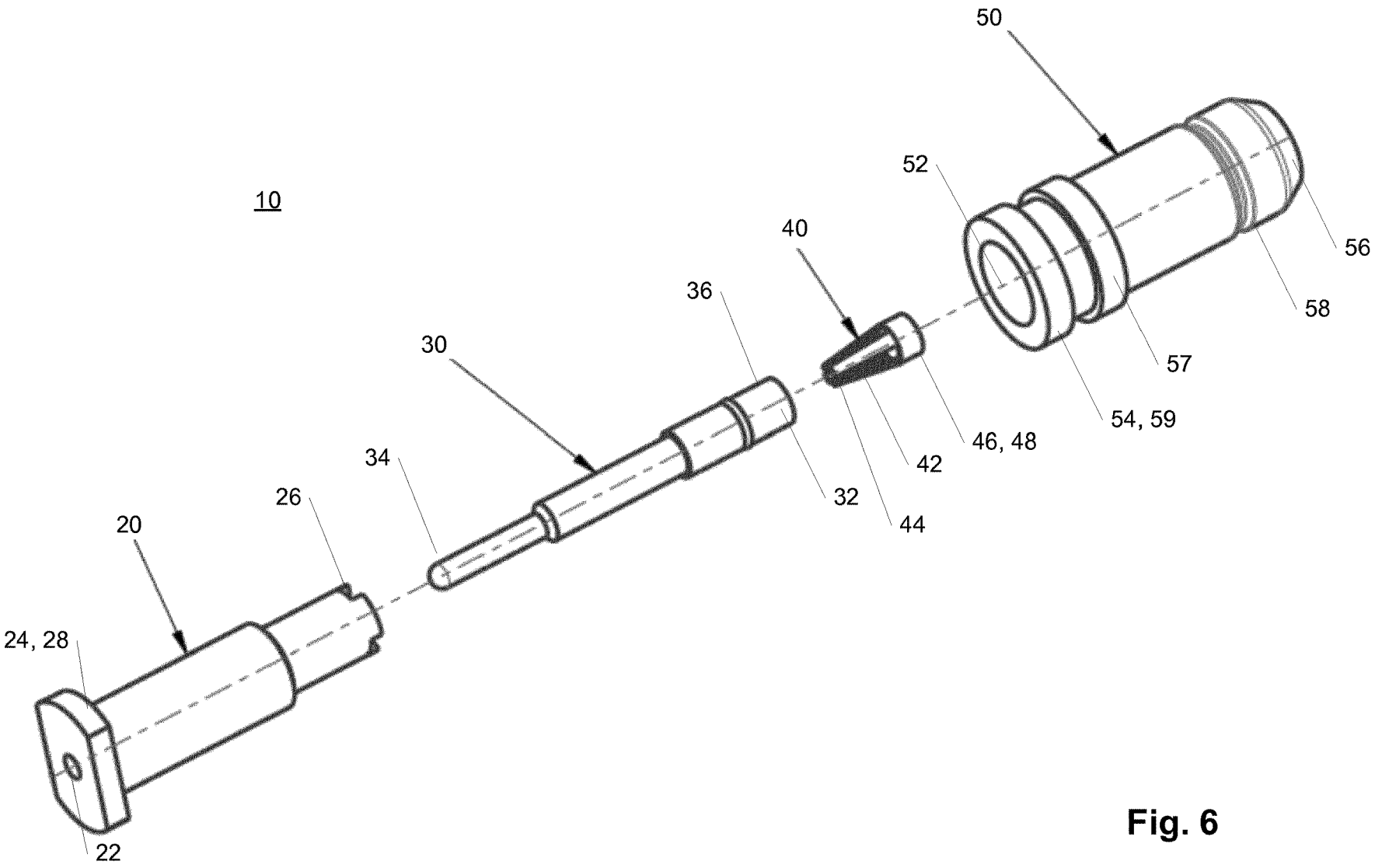
FIG. 6 shows an embodiment of a plug in an exploded view.

Inside the hollow assembly tube 70 is the internal plug part 10, which is seen most clearly in the exploded view in FIG. 6. The internal plug part 10 comprises an inner insulator 20 with a through-going opening 22 extending from a front end 26 to a rear end 24 of the inner insulator 20. The inner insulator 20 has a rear end plate 28, which ensures that the inner insulator 20 is positioned correctly inside the contact tube 50. The contact tube having a front end 56 and a rear end 54 has a through-going opening 52 through which the inner insulator 20 extends. The contact tube 50 also has a fixation recess 58 towards its front end 56, which provides both a contact point for an electric connection with the receptacle and also ensures that the plug is fixed inside the receptacle, when inserted therein (see FIG. 9). The rear end 54 of the contact tube 50 will normally be electrically connected to the cable 200 as shown in FIG. 1, e.g. to a second wire 204 comprised in the cable 200.

The front end 56 of the contact tube 50 will normally be tapered. The contact tube 50 also normally comprises a first outer protrusion 57 and the second outer protrusion 59. The protrutions 57, 59 provides stability to the internal plug part 10. Further, the protrusions 57, 59 ensure a thigther fitting of the contact tube 50 inside an outer insulator 60 as shown in FIGS. 7*a-b*. The additional fixation of the contact tube inside the outer insulator 60 is advantageous when plug and receptacle parts are connected and dis-connected. The protrutions 57, 59 may have different shapes as long as they fulfil a similar purpose.

The rear end 24 of the insulator 20 is in direct contact with the rear end 54 of the contact tube 50.

The plug also comprises an inner contact spring 40 having a rear end 44 and a front end 46. The front end 46 of the inner contact spring 40 connects electrically with the the receptacle contact parts, when the plug 1 is inserted inside the receptacle 100 as shown and described in more details in FIGS. 8 and 9. The inner contact spring 40 comprises a number of extending arms 42 extending from a ring shaped part 48 at the front end 46 of the inner contact spring 40 towards the rear end 44 of the inner contact spring 40.

A plug contact pin 30 is extending inside the through-going opening 22 of the inner insulator 20. The plug contact pin 30 comprises a plug contact pin opening 32 at the front end of the plug contact pin 30. Inside this opening 32, the inner contact spring 40 is positioned. The rear end 34 of the plug 30 protrudes through the opening 22 at the rear end 24 of the insulator 20 thereby allowing the plug contact pin 30 to be electrically connected to a cable 200, e.g. a first wire 202 comprised in a cable 200 as shown in FIG. 1.

As shown in FIG. 3, the plug may also have a lip seal 78 positioned between the front end 76 of the hollow assembly tube 70 and the contact tube 50. The lip seal 78 will compress when the plug is connected with the receptacle, which ensures a tighter fit between the plug and the receptacle when the two parts are connected. The lip seal 78 may therefore extend radially all the way around an outer surface of the contact tube 50.

Figure 2:
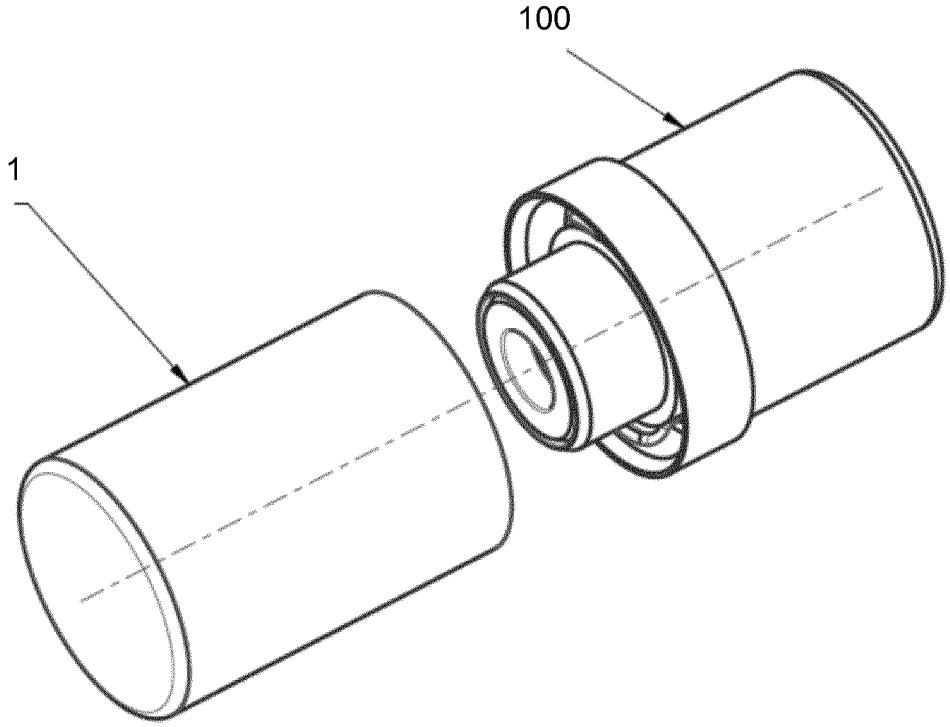
FIG. 2 shows a second embodiment of a receptacle part and a plug.

FIGS. 2 and 5 (FIG. 5 being an exploded view) displays a second embodiment of a receptacle part 100 comprising the inner receptacle part 110 as described above and an outer contact tube 160 having a through-going opening 162 containing the inner receptacle part 110. The outer contact tube 160 is extending from a rear end 164 to a front end 166.

As shown in the figures, the outer contact tube 160 also has a contact protrusion 168 at the rear end 164. The contact protrusion 168 protrudes from the rear end 134 of the inner contact base 130 allowing electrical contact to be made with the outer contact tube 160 by connecting an external electrical part of the contact protrusion 168.

As seen in e.g. FIG. 5, the receptacle part 100 also comprises an outer contact spring 170 extending around the outer contact tube 160 from a rear end 174 to a front end 176. As shown in FIGS. 8 and 9, the outer contact spring 170 extends a maximum radial distance $D_2$ as measured from the longitudinal axis L, wherein $D_2$ is greater in value than $D_1$.

The outer contact spring 170 shown in FIG. 5 has a ring shaped part 172 at the rear end 174 from where a number of contact extensions 178 extend towards the front end 176. In the figures, two contact extensions 178 are shown, but more may be present.

The rear end 174 of the outer contact spring 170 is positioned at the rear end 104 of the receptacle part 100 allowing electrical contact to be made with the outer contact spring 170.

Between the outer contact tube 160 and the outer contact spring 170 is an outer insulator 180 extending from a rear end 184 to a front end 186.

Enclosing the outer contact spring 170, the outer insulator 180, the outer contact tube 160 and the inner receptacle part 110 is a housing 190 extending from a rear end 194 to a front end 196, The outer contact tube 160, and the outer contact spring 170 are adapted for making electrical contact with two additional plug parts of the plug 1, when the plug 1 is inserted inside the receptacle 100 in a similar manor as the internal receptacle part 110 makes electrical contact with plug parts of the plug 1.

FIG. 7*a* shows a second embodiment of the plug according to the invention, which besides the internal plug part 10 further comprises an outer insulator 60 and an outer contact spring 80. A cut-through view of the assembled plug is shown in FIG. 7*c*.

FIGS. 7*b* and 7*d* show a third embodiment of the plug according to the invention, which compared to FIGS. 7*a* and 7*c* further comprise a lip seal 78. The lip seal 78 is also visible in the exploded view of the plug in FIG. 7*b* and in the side-way cut-through assembled view in FIG. 7*d*. In this embodiment of the plug, the lip seal 78 is ring formed and fits around the outer surface of the contact tube 50. The lip seal 78 is in the assembled version of the plug, positioned around the middle of the plug.

The outer insulator 60 extends from a rear end 64 to a front end 66 and has a rear end ring protrusion 68 at its rear end 64. The outer insulator 60 is positioned inside the hollow assembly tube 70 extending at least partly there through with the rear end ring protrusion 68 being in direct contact with the rear end 74 of the assembly tube 70.

The outer contact spring 80 is positioned between the outer insulator 60 and the internal plug part 10 and extends from a rear end 84 to a front end 86 and having an opening 82 at its rear end. The rear end 34 of the plug contact pin 30 extends through the opening 82 in the outer contact spring 80.

The outer contact spring 80 has a plate shaped part 88 surrounding the opening 82 from where a number of contact extensions 89 extend towards its front end 86. The plate shaped part 88 may be electrically connected to a third wire 206 in a cable 200. Likewise, the assembly tube 70 may be electrically connected to a fourth wire 208 in a cable 200.

As shown in FIG. 9, when the plug 1 is inserted inside the inner receptacle part 110, there is a first electrical connection C1 between the front end 126 of the receptacle contact pin 120 and the inner contact spring 40 positioned inside the plug contact pin opening 32.

A second electrical connection is also present between the fixation recess 58 of the contact tube 50 and the inner contact spring 140 of the plug. The front end 146 of the contact spring 140 engages with the fixation recess 58 of the contact tube 50 in the plug thereby securing the plug inside the receptacle. Thus, the contact tube 50 and the inner contact spring 140 has a fixation function besides the function of creating an electrical connection between the plug and the receptacle.

A third electrical connection C3 is present between the outer contact spring 80 of the plug and the outer contact tube 160 of the receptacle, and a fourth electrical connection C4 is present between the assembly tube 70 of the receptacle and the outer contact spring 170 of the plug.

The figures show plug and receptacles with either two or four connections. However, plug and receptacle systems with three connections may also be imagined. In principle, any of the four shown connections in FIG. 9 may be omitted to obtain a three connection point plug and receptacle.

Thus, a three connection receptacles comprising either of the below combinations are also included in the present invention:

A) the inner receptacle part 110 as described above, the outer contact tube 160 and the housing 190;

B) the inner receptacle part 110 as described above, the outer contact spring 170 and the housing 190;

C) the inner receptacle part 110 where the inner contact spring 140 is omitted, the outer contact tube 160, the outer contact spring 170, the outer insulator 180, and the housing 190;

D) the inner receptacle part 110 where the receptacle pin 120 is omitted, the outer contact tube 160, the outer contact spring 170, the outer insulator 180, and the housing 190.

Likewise, a three connection plugs comprising either of the below combinations are also included in the present invention:

A) the hollow assembly tube 70, the inner insulator 20, the contact tube 50, the outer insulator 60, and the outer contact spring 80;

B) the hollow assembly tube 70, the inner insulator 20, the plug contact pin 30, the inner contact spring 40, the outer insulator 60, and the outer contact spring 80;

C) the hollow assembly tube 70, the inner insulator 20, the plug contact pin 30, the inner contact spring 40, the contact tube 50, the outer insulator 60;

FIGS. 10A-B show close-up views of a cable connected to the plugs of the invention. FIG. 10A shows the cable 200 in a close up view comprising the four wires 202, 204, 206, 208 together constituting a core part 212, which is surrounded by the outer isolating jacket 210. The conducting wires 202, 204, 206, 208 can be lacquered and twisted together as shown in FIG. 10B showing the core part 1012 in a close up view. A strength member (not shown in the figure) may also be included.

In FIG. 10A, the cable 200 is shown with the outer isolating jacket 210 stripped off the wires 202, 204, 206, 208 in both ends with the wires 202, 204, 206, 208 also being separated in both ends. The ends of the wires 202, 204, 206, 208 can therefore be connected to electrical means, and electrical signals can then be transmitted through each of the wires 202, 204, 206, 208.

The wires 202, 204, 206, 208 are preferably lacquered conducting wires, which are isolated from each other due to a lacquer that covers the conducting part of the conducting wires 202, 204, 206, 208. The consequence is that the conducting wires can be isolated from each other without having an outer isolating jacket made of an isolating material such as nylon, silicone, polyethylene, PVC, Polyamid, polyester, Pebax, etc. around each conducting wire. The outer diameters of the conducting wires 202, 204, 206, 208 are hereby reduced dramatically, and as a result, the outer diameter of the isolating wire 202, 204, 206, 208 is reduced even more.

The flexibility and softness of the isolated wire 202, 204, 206, 208 are further improved as the relatively inflexible and hard outer isolating jackets often used around conducting wires are omitted. A strength member improves the strength of the cable, and the strength of the cable can be designed to specific specifications by choosing the material of the strength member, by regulating the dimensions of the strength member or by choosing to have more than one strength member integrated into the cable 200. Alternatively, if a very soft and flexible cable is needed, strength members can be omitted.

The cable used in this invention is further less sensitive to noise such as electro mechanical (EM) noise, because the lacquered conducting wires are twisted. Thus, the cable 200 according to the present invention combines flexibility, softness and strength.

FIG. 10B illustrates one end of the cable 200 shown in FIG. 10A without the outer isolating jacket 210. It can be seen that the lacquered conducting wires 202, 204, 206, 208 are twisted together such that they form a helix. The stiffness, softness and strength of the cable 200 can be modified to fit different customer specifications by varying the materials and dimensions of the cable 200 and/or the strength member possibly included in the cable 200. The strength of the cable 200 could for instance be increased by adding more strength members, by choosing strength member(s) made of a strong material and/or by increasing the dimensions of the strength member(s) and/or the conducting wires 202, 204, 206, 208. The strength member(s) could for instance be made of heat-resistant and strong synthetic fibers which do not extend in length when stretched. Such fibers could for instance be aramid fibers.

Depending on the stiffness, softness and strength of the cable, it may be suited for applications, where it is placed near skin or near cloth depending on the static electricity created by the different environment it is near.

The thin conducting magnet wires 202, 204, 206, 208 shown in FIGS. 10A-B could e.g. be magnet wires, which are lacquered individually before they are twisted together thus forming a helix. The consequence is that the lacquered conducting wire is very flexible and strong as each magnet wire provides strength to the lacquered conducting wire, and since the magnet wires are lacquered individually they can be displaced relatively to each other which results in a flexible conducting wire.

One or more of the wires 202, 204, 206, 208 shown in FIGS. 10A-B could be colored e.g. by using a colored lacquer and thereby forming a tracer for easy identification of the conducting wire 202, 204, 206, 208. The wires 202, 204, 206, 208 could for instance be magnetic and/or lacquered. The lacquering could be obtained by pulling the wires 202, 204, 206, 208 through a bath comprising the lacquerer, by covering the wires 202, 204, 206, 208 with electrostatic powder which melts when heated or by spray painting the wires 202, 204, 206, 208. The lacquer layer could for instance be polyamide, polyurethane or the like. The lacquered conducting wires 202, 204, 206, 208 thereby form litz wires 202, 204, 206, 208 where each magnet wire 202, 204, 206, 208 is lacquered individually.

The twisted wires 202, 204, 206, 208 may be secured to the outer isolating jacket 210 by an adhesive. The cable 200 is hereby made tight because the adhesive prevents air, moist and dirt from entering the outer jacket 210. This improves the cable 200 against corrosion and excludes further sounds from travelling inside the outer isolating jacket 210.

The adhesive may further be used to secure the cable 200 in the plug of the invention. The wires 202, 204, 206, 208 may be tinned at their ends such that it is ensured, in embodiments where each wire 202, 204, 206, 208 comprises a number of individually lacquered magnet wires (which again are twisted together as described in FIGS. 10A-B), that there is an electrical connection between each lacquered magnet wire in the same litz wire. Alternatively, the electrical connection between the lacquered magnet wires could be established by using conducting adhesive or by melting the magnet wires together. The tinned ends further ensures that each lacquered wire can easily be brazed to the plug 1 thereby create a very good contact between the plug 1 and the cable 200.

The individual wires 202, 204, 206, 208 shown in FIGS. 10A-C could for instance be manufactured by lacquering a number of magnet wires and collecting them in a bundle. Some of the lacquered magnet wires could optionally be colored. The bundle of lacquered magnet wires could then be twisted, thus forming a lacquered conducting wire 202, 204, 206, 208, which optionally comprises colored magnet wires for identification purposes. Seven magnet wires are in one embodiment twisted together with two of these magnet wires being colored. However, any number of magnet wires and/or colored magnet wires could in other embodiments be twisted together.

After manufacturing the individual wires 202, 204, 206, 208, a number of them and a strength member 1008 could be twisted together and an outer jacket extruded around the twisted conducting wires 202, 204, 206, 208. In one embodiment of the cable 200 shown in FIGS. 10A-B, four conducting wires 202, 204, 206, 208—each comprising different colored magnet wires—are twisted together with an aramid fiber (not shown in the figure) acting as a strength member. The cable 200 thus comprises four lead wires 202, 204, 206, 208, which can easily be identified by their color.

The invention may also be described as described in the following items.

Items

1. A receptacle (100) for a miniaturized connector for use in an audio device, a hearing device or a similar device, the receptacle extending from a rear end (104) towards of front end (106), wherein the receptacle comprises an inner receptacle part (110) comprising:
   - a receptacle contact pin (120) extending from a rear end (124) to a front end (126);
   - an inner contact base (130) extending from a rear end (134) to a front end (136), wherein the inner contact base (130) comprises a through-going opening (132) through which the receptacle contact pin (120) extends, and one or more additional openings (138);
   - an inner contact spring (140) extending from a rear end (144) to a front end (146), the inner contact spring (140) being secured at its rear end (144) inside the one or more additional openings (138) in the inner contact base (130), and
   - an insulator (150) extending from a rear end (154) to a front end (156), and having a through-going opening (152) containing the front ends (146, 136, 126) of the inner contact spring (140), the inner contact base (130), and the contact pin (120), wherein the receptacle contact pin (120), and contact spring (140) are adapted for making electrical contact with two plug parts in a plug (1), when the plug (1) is inserted inside the receptacle (100).

2. A receptacle according to item 1, wherein the rear end (124) of the inner contact pin (120) protrudes from the rear end (134) of the inner contact base (130).

3. A receptacle according to any preceding item, wherein the front end (126) of the inner contact pin (120) protrudes from the front end (136) of the inner contact base (130).

4. A receptacle according to any preceding item, wherein at least one of the one or more additional openings (138) is extending all the way through the inner contact base (130).

5. A receptacle according to any preceding item, wherein the inner contact spring (140) comprises a contact protrusion (142) at the rear end (144) of the inner contact spring (140), the contact protrusion (142) extending rearward from the rear end (134) of the inner contact base (130) allowing electrical contact to be made with the inner contact spring (140).

6. A receptacle according to any preceding item, wherein the inner contact spring (140) comprises a number of protruding parts (148) formed as arms extending from the rear end (144) of the inner contact spring (140) in an approximately straight line towards the front end (146) of the inner contact spring (140) where the protruding parts (148) bends towards a centre point of the inner contact spring.

7. A receptacle according to item 6, wherein the protruding parts (148) are flexible.

8. A receptacle according to any preceding item, wherein the inner contact base (130) is an insulator.

9. A receptacle according to any preceding item, wherein the rear end (124) of the receptacle contact pin (120) extends rearward from the rear end (134) of the inner contact base (130) allowing electrical contact to be made with the receptacle contact pin (120).

10. A receptacle (100) according to any of the preceding items 1-9 further comprising:
   - an outer contact spring (170) extending around the inner receptacle part (110) from a rear end (174) to a front end (176);
   - a housing (190) extending from a rear end (194) to a front end (196), the housing (190) enclosing the outer contact spring (170), and the inner receptacle part (110), wherein the receptacle contact pin (120), inner contact spring (140, and the outer contact spring (170) are adapted for making electrical contact with three plug parts in a plug (1), when the plug (1) is inserted inside the receptacle (100).

11. A receptacle (100) according to any of the preceding items 1-9 further comprising:
   - an outer contact tube (160) extending from a rear end (164) to a front end (166), and having a through-going opening (162), wherein the inner receptacle part (110) extends through the outer contact tube (160);
   - an outer contact spring (170) extending around the outer contact tube (160) from a rear end (174) to a front end (176);
   - an outer insulator (180) extending from a rear end (184) to a front end (186), the outer insulator (180) being positioned between the outer contact tube (160) and the outer contact spring (170),
   - a housing (190) extending from a rear end (194) to a front end (196), the housing (190) enclosing the outer contact spring (170), the outer insulator (180), the outer contact tube (160) and the inner receptacle part (110), wherein the outer contact tube (160), and the outer contact spring (170) are adapted for making electrical contact with two additional plug parts of the plug (1), when the plug (1) is inserted inside the receptacle (100).

12. A receptacle according to any of the preceding items 10-11, wherein the outer contact spring (170) comprises a ring shaped part (172) at the rear end (174) of the outer contact spring (170) from where a number of contact extensions (178) extend towards the front end (176) of the outer contact spring (170).

13. A receptacle according to item 12, wherein the number of contact extensions (178) includes two contact extensions (178).

14. A receptacle according to any of the preceding items 10-13, wherein the rear end (174) of the outer contact spring (170) is positioned at the rear end (104) of the receptacle allowing electrical contact to be made with the outer contact spring (170).

15. A receptacle (100) according to any of the preceding items 1-9 further comprising:
   - an outer contact tube (160) extending from a rear end (164) to a front end (166), and having a through-going opening (162), wherein the inner receptacle part (110) extends through the outer contact tube (160);

a housing (190) extending from a rear end (194) to a front end (196), the housing (190) enclosing the outer contact tube (160) and the inner receptacle part (110), wherein the receptacle contact pin (120), inner contact spring (140), and the outer contact tube (160) are adapted for making electrical contact with three plug parts in a plug (1), when the plug (1) is inserted inside the receptacle (100).

16. A receptacle according to any of the preceding items 1-9 and 11-14, wherein the outer contact tube (160) comprises a contact protrusion (168) at the rear end (164) of the outer contact tube (160).

17. A receptacle according to item 16, wherein the contact protrusion (168) of the outer contact tube (160) protrudes from the rear end (134) of the inner contact base (130) allowing electrical contact to be made with the outer contact tube (160).

18. A receptacle (100) for a miniaturized connector for use in an audio device, a hearing device or a similar device, the receptacle extending from a rear end (104) towards of front end (106), wherein the receptacle comprises:

an inner receptacle part (110) comprising:

a receptacle contact pin (120) extending from a rear end (124) to a front end (126);

an inner contact base (130) extending from a rear end (134) to a front end (136), wherein the inner contact base (130) comprises a through-going opening (132) through which the receptacle contact pin (120) extends, and one or more additional openings (138);

an insulator (150) extending from a rear end (154) to a front end (156), and having a through-going opening (152) containing the inner contact base (130), and the contact pin (120), an outer contact tube (160) extending from a rear end (164) to a front end (166), and having a through-going opening (162), wherein the inner receptacle part (110) extends through the outer contact tube (160);

an outer contact spring (170) extending around the outer contact tube (160) from a rear end (174) to a front end (176);

an outer insulator (180) extending from a rear end (184) to a front end (186), the outer insulator (180) being positioned between the outer contact tube (160) and the outer contact spring (170), a housing (190) extending from a rear end (194) to a front end (196), the housing (190) enclosing the outer contact spring (170), the outer insulator (180), the outer contact tube (160) and the inner receptacle part (110), wherein the receptacle contact pin (120), the outer contact tube (160), and the outer contact spring (170) are adapted for making electrical contact with three plug parts in a plug (1), when the plug (1) is inserted inside the receptacle (100).

19. A receptacle (100) for a miniaturized connector for use in an audio device, a hearing device or a similar device, the receptacle extending from a rear end (104) towards of front end (106), wherein the receptacle comprises:

an inner receptacle part (110) comprising:

an inner contact base (130) extending from a rear end (134) to a front end (136), wherein the inner contact base (130) comprises one or more additional openings (138);

an inner contact spring (140) extending from a rear end (144) to a front end (146), the inner contact spring (140) being secured at its rear end (144) inside the one or more additional openings (138) in the inner contact base (130), and an insulator (150) extending from a rear end (154) to a front end (156), and having a through-going opening (152) containing the front ends (146, 136, 126) of the inner contact spring (140), and the inner contact base (130), an outer contact tube (160) extending from a rear end (164) to a front end (166), and having a through-going opening (162), wherein the inner receptacle part (110) extends through the outer contact tube (160);

an outer contact spring (170) extending around the outer contact tube (160) from a rear end (174) to a front end (176);

an outer insulator (180) extending from a rear end (184) to a front end (186), the outer insulator (180) being positioned between the outer contact tube (160) and the outer contact spring (170), a housing (190) extending from a rear end (194) to a front end (196), the housing (190) enclosing the outer contact spring (170), the outer insulator (180), the outer contact tube (160) and the inner receptacle part (110), wherein inner contact spring (140), the outer contact tube (160), and the outer contact spring (170) are adapted for making electrical contact with three plug parts in a plug (1), when the plug (1) is inserted inside the receptacle (100).

20. A plug (1) for a miniaturized connector for use in an audio device, a hearing device or a similar device, wherein the plug (1) comprises an internal plug part (10) comprising:

an inner insulator (20) with a through-going opening (22) extending from a front end (26) to a rear end (24) of the inner insulator (20);

an inner contact spring (40) having a rear end (44) and a front end (46);

a plug contact pin (30) extending inside the through-going opening (22) of the inner insulator (20), the plug contact pin (30) having a rear end (34) and a front end (36), the front end (36) comprising a plug contact pin opening (32) inside of which the inner contact spring (40) is positioned, and a contact tube (50) having a front end (56), a rear end (54) and a through-going opening through which the inner insulator (20) extends, wherein the contact tube (50) further comprises a fixation recess (58), wherein the inner contact spring (40) and the contact tube (50) are adapted for making electrical contact with two receptacle contact parts, when the plug (1) is inserted inside the receptacle (100).

21. A plug according to item 20, wherein the rear end (24) of the insulator (20) is in direct contact with the rear end (54) of the contact tube (50).

22. A plug according to any of the items 20-21, wherein the front end (56) of the contact tube (50) is tapered.

23. A plug according to any of the items 20-22, wherein the contact tube (50) further comprises a first outer protrusion (57) and the second outer protrusion (59).

24. A plug according to any of the items 20-23, wherein the inner contact spring (40) comprises a number of extending arms (42) extending from a ring shaped part (48) at the front end (46) of the inner contact spring (40) towards the rear end (44) of the inner contact spring.

25. A plug according to any of the items 20-24, wherein the rear end (34) of the plug contact pin (30) extends from the rear end (24) of the inner insulator (20) thereby allowing the plug contact pin (30) to be electrically connected to a first wire (202) comprised in a cable (200).

26. A plug according to any of the items 20-25, wherein the rear end (54) of the contact tube (50) is electrically connected to a second wire (204) comprised in a cable (200).

27. A plug according to any of the items 20-26, the plug further comprising the cable (200) with a number of wires including at least the first wire (202) and the second wire (204).

28. A plug according to any of the items 20-27 further comprising a hollow assembly tube (70), the hollow assembly tube (70) extending from a rear end (74) to a front end (76), wherein enclosed in the hollow assembly tube (70) and extending from its front end (76) is the internal plug part (10).

29. A plug according to item 28 further comprising a lip seal (78) positioned around the contact tube (50).

30. A plug according to item 28 further comprising a lip seal (78) positioned the hollow assembly tube (70) and the contact tube (50).

31. A plug according to item 30, wherein the lip seal (78) positioned between the front end (76) of the hollow assembly tube (70) and the contact tube (50).

32. A plug according to any of the items 29-31, wherein the lip seal (78) compresses when the plug is connected with the receptacle.

33. A plug according to any of the items 29-32, wherein the lip seal (78) extends radially all the way around an outer surface of the contact tube (50).

34. A plug according to any of the items 20-33 further comprising:

an outer insulator (60) extending from a rear end (64) to a front end (66) and having a rear end ring protrusion (68) at the rear end (64) of the outer insulator (60), wherein the outer insulator (60) is positioned inside the hollow assembly tube (70) extending at least partly there through with the rear end ring protrusion (68) being in direct contact with the rear end (74) of the assembly tube (70), and an outer contact spring (80) positioned between the outer insulator (60) and the internal plug part (10), the outer contact string (80) extending from a rear end (84) to a front end (86) and having an opening (82) at the rear end (84) through which the rear end (34) of the plug contact pin (30) extends, wherein the outer contact spring (80) and the assembly tube (70) are adapted for making electrical contact with two additional receptacle contact parts, when the plug (1) is inserted inside the receptacle (100).

35. A plug according to item 34, wherein the outer contact spring (80) comprises a plate shaped part (88) surrounding the opening (82) at the rear end (84) of the outer contact spring (80) from where a number of contact extensions (89) extend towards the front end (86) of the outer contact spring (80).

36. A plug according to item 35, wherein the plate shaped part (88) is electrically connected to a third wire (206) in a cable (200).

37. A plug according to any of the items 35-36, wherein the assembly tube (70) is electrically connected to a fourth wire (208) in a cable (200).

38. A plug according to item 37, wherein the cable (200) comprises the third wire (206) and the fourth wire (208).

39. A plug (1) for a miniaturized connector for use in an audio device, a hearing device or a similar device, wherein the plug (1) comprises an internal plug part (10) and a hollow assembly tube (70), the hollow assembly tube (70) extending from a rear end (74) to a front end (76), wherein enclosed in the hollow assembly tube (70) and extending from its front end (76) is the internal plug part (10), the internal plug part (10) comprising:

an inner insulator (20) with a through-going opening (22) extending from a front end (26) to a rear end (24) of the inner insulator (20);

an inner contact spring (40) having a rear end (44) and a front end (46);

a plug contact pin (30) extending inside the through-going opening (22) of the inner insulator (20), the plug contact pin (30) having a rear end (34) and a front end (36), the front end (36) comprising a plug contact pin opening (32) inside of which the inner contact spring (40) is positioned, and a contact tube (50) having a front end (56), a rear end (54) and a through-going opening through which the inner insulator (20) extends, wherein the contact tube (50) further comprises a fixation recess (58), wherein the plug further comprises:

an outer insulator (60) extending from a rear end (64) to a front end (66) and having a rear end ring protrusion (68) at the rear end (64) of the outer insulator (60), wherein the outer insulator (60) is positioned inside the hollow assembly tube (70) extending at least partly there through with the rear end ring protrusion (68) being in direct contact with the rear end (74) of the assembly tube (70), and an outer contact spring (80) positioned between the outer insulator (60) and the internal plug part (10), the outer contact string (80) extending from a rear end (84) to a front end (86) and having an opening (82) at the rear end (84) through which the rear end (34) of the plug contact pin (30) extends, wherein the inner contact spring (40), the contact tube (50), and the outer contact spring (80) are adapted for making electrical contact with three additional receptacle contact parts, when the plug (1) is inserted inside the receptacle (100).

40. A plug (1) for a miniaturized connector for use in an audio device, a hearing device or a similar device, wherein the plug (1) comprises an internal plug part (10) and a hollow assembly tube (70), the hollow assembly tube (70) extending from a rear end (74) to a front end (76), wherein enclosed in the hollow assembly tube (70) and extending from its front end (76) is the internal plug part (10), the internal plug part (10) comprising:

an inner insulator (20) with a through-going opening (22) extending from a front end (26) to a rear end (24) of the inner insulator (20), and a contact tube (50) having a front end (56), a rear end (54) and a through-going opening through which the inner insulator (20) extends, wherein the contact tube (50) further comprises a fixation recess (58), wherein the plug further comprises:

an outer insulator (60) extending from a rear end (64) to a front end (66) and having a rear end ring protrusion (68) at the rear end (64) of the outer insulator (60), wherein the outer insulator (60) is positioned inside the hollow assembly tube (70) extending at least partly there through with the rear end ring protrusion (68) being in direct contact with the rear end (74) of the assembly tube (70), and an outer contact spring (80) positioned between the outer insulator (60) and the internal plug part (10), the outer contact string (80) extending from a rear end (84) to a front end (86), wherein the contact tube (50), the outer contact spring (80) and the assembly tube (70) are adapted for making electrical contact with three additional receptacle contact parts, when the plug (1) is inserted inside the receptacle (100).

41. A plug (1) for a miniaturized connector for use in an audio device, a hearing device or a similar device, wherein the plug (1) comprises an internal plug part (10) and a hollow assembly tube (70), the hollow assembly tube (70) extending from a rear end (74) to a front end (76), wherein enclosed in the hollow assembly tube (70) and extending from its front end (76) is the internal plug part (10), the internal plug part (10) comprising:

an inner insulator (20) with a through-going opening (22) extending from a front end (26) to a rear end (24) of the inner insulator (20);

an inner contact spring (40) having a rear end (44) and a front end (46);

a plug contact pin (30) extending inside the through-going opening (22) of the inner insulator (20), the plug contact pin (30) having a rear end (34) and a front end (36), the front end (36) comprising a plug contact pin opening (32) inside of which the inner contact spring (40) is positioned, and wherein the plug further comprises:

an outer insulator (60) extending from a rear end (64) to a front end (66) and having a rear end ring protrusion (68) at the rear end (64) of the outer insulator (60), wherein the outer insulator (60) is positioned inside the hollow assembly tube (70) extending at least partly there through with the rear end ring protrusion (68) being in direct contact with the rear end (74) of the assembly tube (70), and an outer contact spring (80) positioned between the outer insulator (60) and the internal plug part (10), the outer contact string (80) extending from a rear end (84) to a front end (86) and having an opening (82) at the rear end (84) through which the rear end (34) of the plug contact pin (30) extends, wherein the inner contact spring (40), the outer contact spring (80) and the assembly tube (70) are adapted for making electrical contact with three additional receptacle contact parts, when the plug (1) is inserted inside the receptacle (100).

42. A plug (1) for a miniaturized connector for use in an audio device, a hearing device or a similar device, wherein the plug (1) comprises an internal plug part (10) and a hollow assembly tube (70), the hollow assembly tube (70) extending from a rear end (74) to a front end (76), wherein enclosed in the hollow assembly tube (70) and extending from its front end (76) is the internal plug part (10), the internal plug part (10) comprising:

an inner insulator (20) with a through-going opening (22) extending from a front end (26) to a rear end (24) of the inner insulator (20);

an inner contact spring (40) having a rear end (44) and a front end (46);

a plug contact pin (30) extending inside the through-going opening (22) of the inner insulator (20), the plug contact pin (30) having a rear end (34) and a front end (36), the front end (36) comprising a plug contact pin opening (32) inside of which the inner contact spring (40) is positioned, and a contact tube (50) having a front end (56), a rear end (54) and a through-going opening through which the inner insulator (20) extends, wherein the contact tube (50) further comprises a fixation recess (58), wherein the inner contact spring (40) and the contact tube (50), and the assembly tube (70) are adapted for making electrical contact with three additional receptacle contact parts, when the plug (1) is inserted inside the receptacle (100).

43. A miniaturized connector for use in an audio device, a hearing device or a similar device, wherein the connector comprises a receptacle (100) according to items 1-19 and a plug (1) according to items 20-42.

44. A miniaturized connector according to item 43, wherein when the plug is inserted into the receptacle, there is a first electrical connection between the front end (126) of the receptacle contact pin (120) and the inner contact spring (40) of the plug positioned inside the plug contact pin opening (32).

45. A miniaturized connector according to item 43 or 44, wherein when the plug is inserted into the receptacle, there is a second electrical connection between the contact tube (50) of the receptacle and the inner contact spring (140) of the plug.

46. A miniaturized connector according to item 45, wherein the front end (142) of the inner contact spring (140) engages with the fixation recess (58) of the contact tube (50) thereby securing the plug inside the receptacle.

47. A miniaturized connector according to any of the items 43-46, wherein when the plug is inserted into the receptacle, there is a third electrical connection between the outer contact spring (80) of the plug and the outer contact tube (160) of the receptacle (100).

48. A miniaturized connector according to any of the items 43-47, wherein when the plug is inserted into the receptacle, there is a fourth electrical connection between the assembly tube (70) of the plug and the outer contact spring (170) of the receptacle.

REFERENCES

1 plug
10 internal plug part
20 inner insulator
22 through-going opening in the inner insulator
24 rear end of the inner insulator
26 front end of the inner insulator
28 rear end plate of the inner insulator
30 plug contact pin
32 opening in the plug contact pin
34 rear end of the plug contact pin
36 front end of the plug contact pin
40 inner contact spring
42 extending arms of the inner contact spring
44 rear end of the inner contact spring
46 front end of the inner contact spring
48 ring shaped part of the inner contact spring
50 contact tube
52 through-going opening of the contact tube
54 rear end of the contact tube
56 front end of the contact tube
57 first outer protrusion
58 fixation recess of the contact tube
59 second outer protrusion
60 outer insulator
64 rear end of the outer insulator
66 front end of the outer insulator
68 ring protrusion of the outer insulator
70 hollow assembly tube
72 opening in the assembly tube
74 rear end of the hollow assembly tube
76 front end of the hollow assembly tube
78 lip seal
80 outer contact spring
82 opening at the rear end of the outer contact spring
84 rear end of the outer contact spring

86 front end of the outer contact spring
88 plate shaped part at the rear end of the outer contact spring
89 contact extensions of the outer contact spring
100 receptacle
104 rear end of the receptacle
106 front end of the receptacle
110 inner receptacle part
120 receptacle contact pin
124 rear end of the receptacle contact pin
126 front end of the receptacle contact pin
130 inner contact base
132 through-going opening of the inner contact base
134 rear end of the inner contact base
136 front end of the inner contact base
138 additional openings in the inner contact base
140 inner contact spring
142 contact protrusion of the inner contact spring
144 rear end of the inner contact spring
146 front end of the inner contact spring
148 protruding parts of the inner contact spring formed as arms/strings
150 insulator
152 through-going opening of the insulator
154 rear end of the insulator
156 front end of the insulator
160 outer contact tube
162 through-going opening of the outer contact tube
164 rear end of the outer contact tube
166 front end of the outer contact tube
168 contact protrusion at the rear end of the outer contact tube
170 outer contact spring
172 ring shaped part of the outer contact spring
174 rear end of the outer contact spring
176 front end of the outer contact spring
178 contact extensions of the outer contact spring
180 outer insulator
184 rear end of the outer insulator
186 front end of the outer insulator
190 housing
192 opening in the housing
194 rear end of the housing
196 front end of the housing
200 cable
202 first wire
204 second wire
206 third wire
208 fourth wire
210 isolating jacket
212 core part of the cable
C1 first electrical connection
C2 second electrical connection
C3 third electrical connection
C4 fourth electrical connection

The invention claimed is:

1. A receptacle for a miniaturized connector for use in an audio device, a hearing device or a similar device, the receptacle extending from a rear end towards of front end, wherein the receptacle comprises:

an inner receptacle part, wherein the inner receptacle part comprises:

a receptacle contact pin extending along a longitudinal axis from a rear end to a front end;

an inner contact base extending from a rear end to a front end, wherein the inner contact base is an insulator, and wherein the inner contact base comprises a through-going opening through which the receptacle contact pin extends, and one or more additional openings;

an inner contact spring extending from a rear end to a front end, the inner contact spring being secured at its rear end inside the one or more additional openings in the inner contact base, and wherein the inner contact spring comprises a number of protruding parts formed as arms extending from the rear end of the inner contact spring in an approximately straight line towards the front end of the inner contact spring where the protruding parts bends towards a center point of the inner contact spring;

an insulator extending from a rear end to a front end, and having a through-going opening containing the front ends of the inner contact spring, the inner contact base, and the contact pin, wherein the insulator extends radially a maximum distance $D_1$ as measured from the longitudinal axis; and wherein the receptacle contact pin, and contact spring are adapted for making electrical contact with two plug parts in a plug, when the plug is inserted inside the receptacle;

wherein the receptacle further comprises:

an outer contact spring extending around the inner receptacle part from a rear end to a front end, wherein the outer contact spring extends radially a maximum distance $D_2$ as measured from the longitudinal axis, and wherein $D_2>D_1$; and a housing extending from a rear end to a front end, the housing enclosing the outer contact spring, and the inner receptacle part, wherein the outer contact spring is adapted for making electrical contact with a plug part in a plug, when the plug is inserted inside the receptacle.

2. The receptacle according to claim 1, wherein the rear end of the inner contact pin protrudes from the rear end of the inner contact base or wherein the front end of the inner contact pin protrudes from the front end of the inner contact base.

3. The receptacle according to claim 1, wherein at least one of the one or more additional openings is extending all the way through the inner contact base.

4. The receptacle according to claim 1, wherein the inner contact spring comprises a contact protrusion at the rear end of the inner contact spring, the contact protrusion extending rearward from the rear end of the inner contact base allowing electrical contact to be made with the inner contact spring and wherein the protruding parts are flexible.

5. The receptacle according to claim 1, wherein the rear end of the receptacle contact pin extends rearward from the rear end of the inner contact base allowing electrical contact to be made with the receptacle contact pin.

6. The receptacle according to claim 1 further comprising:

an outer contact tube extending from a rear end to a front end, and having a through-going opening, wherein the inner receptacle part extends through the outer contact tube;

an outer insulator extending from a rear end to a front end, the outer insulator being positioned between the outer contact tube and the outer contact spring;

wherein the housing is enclosing the outer contact spring; and wherein the outer contact tube is adapted for making electrical contact with the plug part of the plug, when the plug inserted inside the receptacle.

7. The receptacle according to claim 6, wherein the outer contact tube comprises a contact protrusion at the rear end of the outer contact tube.

8. The receptacle according to claim 7, wherein the contact protrusion of the outer contact tube protrudes from the rear end of the inner contact base allowing electrical contact to be made with the outer contact tube.

9. The receptacle according to claim 1, wherein the outer contact spring comprises a ring-shaped part at the rear end of the outer contact spring from where a number of contact extensions extend towards the front end of the outer contact spring, wherein the number of contact extensions includes two contact extensions.

10. The receptacle according to claim 1, wherein the rear end of the outer contact spring is positioned at the rear end of the receptacle allowing electrical contact to be made with the outer contact spring.

11. The receptacle according to claim 1 further comprising:

an outer contact tube extending from a rear end to a front end, and having a through-going opening, wherein the inner receptacle part extends through the outer contact tube;

a housing extending from a rear end to a front end, the housing enclosing the outer contact tube and the inner receptacle part, wherein the receptacle contact pin, inner contact spring, and the outer contact tube are adapted for making electrical contact with three plug parts in a plug, when the plug is inserted inside the receptacle.

12. The receptacle according to claim 1, wherein the outer contact spring extends around the insulator from a rear end to a front end.

13. A plug for a miniaturized connector for use in an audio device, a hearing device or a similar device, wherein the plug comprises an internal plug part comprising:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and a contact tube having a front end, a rear end and a through-going opening through which the inner insulator extends, wherein the contact tube further comprises a fixation recess adapted for securing the plug inside a receptacle, the receptacle comprising a contact spring with a front end, wherein the front end of the contact spring is configured to engage with the fixation recess of the contact tube thereby securing the plug inside a receptacle;

wherein the rear end of the insulator is in direct contact with the rear end of the contact tube;

wherein the inner insulator comprises a rear end plate adapted for ensuring that the inner insulator is positioned correctly inside the contact tube; and wherein the inner contact spring and the contact tube are adapted for making electrical contact with two receptacle contact parts of the receptacle, when the plug is inserted inside the receptacle.

14. The plug according to claim 13, wherein the front end of the contact tube is tapered.

15. The plug according to claim 13, wherein the contact tube further comprises a first outer protrusion and a second outer protrusion.

16. The plug according to claim 13, wherein the inner contact spring comprises a number of extending arms extending from a ring-shaped part at the front end of the inner contact spring towards the rear end of the inner contact spring.

17. The plug according to claim 13, wherein the plug further comprises a cable with a number of wires comprising at least a first wire and a second wire, wherein the rear end of the plug contact pin extends from the rear end of the inner insulator thereby allowing the plug contact pin to be electrically connected to the first wire and the rear end of the contact tube is electrically connected to the second wire.

18. The plug according to claim 13 further comprising a hollow assembly tube, the hollow assembly tube extending from a rear end to a front end, wherein enclosed in the hollow assembly tube and extending from its front end is the internal plug part.

19. The plug according to claim 18 further comprising a lip seal positioned around the contact tube or the hollow assembly tube and the contact tube.

20. The plug according to claim 19, wherein the lip seal extends radially all the way around an outer surface of the contact tube.

21. The plug according to claim 13 further comprising:

an outer insulator extending from a rear end to a front end and having a rear end ring protrusion at the rear end of the outer insulator, wherein the outer insulator is positioned inside the hollow assembly tube extending at least partly there through with the rear end ring protrusion being in direct contact with the rear end of the assembly tube, and an outer contact spring positioned between the outer insulator and the internal plug part, the outer contact string extending from a rear end to a front end and having an opening at the rear end through which the rear end of the plug contact pin extends;

wherein the outer contact spring and the assembly tube are adapted for making electrical contact with two additional receptacle contact parts, when the plug is inserted inside the receptacle.

22. The plug according to claim 21, wherein the outer contact spring comprises a plate-shaped part surrounding the opening at the rear end of the outer contact spring from where a number of contact extensions extend towards the front end of the outer contact spring.

23. The plug according to claim 22, wherein the cable comprises a third wire and a fourth wire, and wherein the plate-shaped part is electrically connected to a third wire and wherein the assembly tube is electrically connected to a fourth wire.

24. A miniaturized connector for use in an audio device, a hearing device or a similar device, wherein the miniaturized connector comprises:

a receptacle comprising:

an inner receptacle part, wherein the inner receptacle part comprises:

a receptacle contact pin extending from a rear end to a front end;

an inner contact base extending from a rear end to a front end, wherein the inner contact base is an insulator, and wherein the inner contact base comprises a through-going opening through which the receptacle contact pin extends, and one or more additional openings;

an inner contact spring extending from a rear end to a front end, the inner contact spring being secured at its rear end inside the one or more additional openings in the inner contact base, and wherein the inner contact spring comprises a number of protruding parts formed as arms extending from the rear end of the inner contact spring in an approximately straight line towards the front end of the inner contact spring where the protruding parts bends towards a center point of the inner contact spring;

an insulator extending from a rear end to a front end, and having a through-going opening containing the front ends of the inner contact spring, the inner contact base, and the contact pin; and wherein the receptacle contact pin, and contact spring are adapted for making electrical contact with two plug parts in a plug, when the plug is inserted inside the receptacle; and a plug comprising:

an internal plug part, wherein the internal plug part comprises:

an inner insulator with a through-going opening extending from a front end to a rear end of the inner insulator;

an inner contact spring having a rear end and a front end;

a plug contact pin extending inside the through-going opening of the inner insulator, the plug contact pin having a rear end and a front end, the front end comprising a plug contact pin opening inside of which the inner contact spring is positioned, and a contact tube having a front end, a rear end and a through-going opening through which the inner insulator extends, wherein the contact tube further comprises a fixation recess adapted for securing the plug inside a receptacle, the receptacle comprising a contact spring with a front end, wherein the front end of the contact spring is configured to engage with the fixation recess of the contact tube thereby securing the plug inside a receptacle;

wherein the rear end of the insulator is in direct contact with the rear end of the contact tube;

wherein the inner insulator comprises a rear end plate adapted for ensuring that the inner insulator is positioned correctly inside the contact tube; and wherein the inner contact spring and the contact tube are adapted for making electrical contact with two receptacle contact parts of the receptacle, when the plug is inserted inside the receptacle.

25. The miniaturized connector according to claim 24, wherein when the plug is inserted into the receptacle, there is one or more of:

a first electrical connection between the front end of the receptacle contact pin and the inner contact spring of the plug positioned inside the plug contact pin opening;

a second electrical connection between the contact tube of the plug and the inner contact spring of the receptacle, wherein the front end of the inner contact spring engages with the fixation recess of the contact tube thereby securing the plug inside the receptacle;

a third electrical connection between the outer contact spring of the plug and the outer contact tube of the receptacle, wherein the outer contact tube extends from a rear end to a front end, and wherein the outer contact tube has a through-going opening, wherein the inner receptacle part extends through the outer contact tube; and a fourth electrical connection between the assembly tube of the plug and the outer contact spring of the receptacle, wherein the outer contact spring is extending around the inner receptacle from a rear end to a front end.

26. The miniaturized connector according to claim 25, wherein the outer contact spring extends around the insulator from a rear end to a front end.

* * * * *